US011982091B2

(12) United States Patent
Josefsson et al.

(10) Patent No.: US 11,982,091 B2
(45) **Date of Patent: *May 14, 2024**

(54) MINERAL-BASED PANEL COMPRISING GROOVES AND A METHOD FOR FORMING GROOVES

(71) Applicant: Ceraloc Innovation AB, Viken (SE)

(72) Inventors: Per Josefsson, Ramlösa (SE); Pontus Gamstedt, Kattarp (SE); Per Nygren, Ramlösa (SE)

(73) Assignee: Ceraloc Innovation AB, Viken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 17/831,826

(22) Filed: Jun. 3, 2022

(65) Prior Publication Data

US 2022/0290444 A1 Sep. 15, 2022

Related U.S. Application Data

(63) Continuation of application No. 16/826,761, filed on Mar. 23, 2020, now Pat. No. 11,377,855.

(30) Foreign Application Priority Data

Mar. 25, 2019 (SE) ..... 1950364-8

(51) Int. Cl.
*E04F 15/00* (2006.01)
*E04F 13/076* (2006.01)
(Continued)

(52) U.S. Cl.
CPC ..... *E04F 15/02033* (2013.01); *E04F 13/076* (2013.01); *E04F 13/0894* (2013.01); *E04F 15/087* (2013.01); *E04F 2201/0115* (2013.01)

(58) Field of Classification Search
CPC ..... E04F 15/02033; E04F 15/02038; E04F 15/107; E04F 15/102; E04F 2201/042;
(Continued)

(56) References Cited

U.S. PATENT DOCUMENTS 2,004,917 A 6/1935 Johnson
2,031,596 A 2/1936 Fulbright
(Continued)

FOREIGN PATENT DOCUMENTS

CA 2 903 432 A1 1/2008
DE 2 251 762 A1 5/1974
(Continued)

OTHER PUBLICATIONS

U.S. Appl. No. 17/812,281, Darko Pervan, filed Jul. 13, 2022.
(Continued)

*Primary Examiner* — Chi Q Nguyen
(74) *Attorney, Agent, or Firm* — Boone IP Law

(57) ABSTRACT

A mineral-based floor panel including a mineral-based core, wherein the panel includes at least one groove. The at least one groove may be provided in a rear side of the panel. There is also disclosed other such mineral-based panels, such as a building panel, a wall panel, a ceiling panel or a furniture panel. There is also disclosed a method for forming such grooves in a mineral-based panel. Furthermore, there is disclosed a mineral-based panel including a mineral-based core and polymer-based lower layer(s) attached to the core. A locking system of the panel includes a strip extending horizontally beyond an upper portion of the panel, wherein at least a horizontal portion of the strip is entirely formed in the polymer-based lower layer(s).

19 Claims, 8 Drawing Sheets

(51) Int. Cl.
*E04F 13/08* (2006.01)
*E04F 15/02* (2006.01)
*E04F 15/08* (2006.01)

(58) Field of Classification Search
CPC ..... E04F 2201/0107; E04F 2201/03; E04F 2201/0552; E04F 2201/023; E04F 2201/0535; E04F 2201/0146; E04F 2201/043; E04F 2201/0547; E04F 2201/0153; E04F 2201/0138
USPC .. 52/592.1, 592.3, 592.2, 578, 588.1, 309.1, 52/309.3
See application file for complete search history.

(56) References Cited

U.S. PATENT DOCUMENTS 2,088,238 A 7/1937 Greenway
2,269,927 A 1/1942 Crooks
2,324,628 A 7/1943 Kähr
3,234,074 A 2/1966 Bryant
3,619,964 A 11/1971 Passaro et al.
3,908,053 A 9/1975 Hettich
5,103,614 A 4/1992 Kawaguchi et al.
5,109,898 A 5/1992 Schacht
5,190,799 A 3/1993 Elingson, III
5,208,086 A 5/1993 Owens
5,540,025 A 7/1996 Takehara et al.
5,879,781 A 3/1999 Mehta et al.
5,900,099 A 5/1999 Sweet et al.
6,156,402 A 12/2000 Smith
6,182,413 B1 2/2001 Magnusson
6,455,127 B1 9/2002 Valtanen
6,465,046 B1 10/2002 Hansson et al.
6,558,070 B1 5/2003 Valtanen
6,761,008 B2 7/2004 Chen et al.
6,769,219 B2 8/2004 Schwitte et al.
6,772,568 B2 8/2004 Thiers et al.
6,895,881 B1 5/2005 Whitaker
6,953,105 B2 10/2005 Rust et al.
7,152,379 B2 12/2006 Lin et al.
7,337,588 B1 3/2008 Moebus
7,413,374 B2 8/2008 Rogers et al.
7,918,062 B2 4/2011 Chen
8,029,880 B2 10/2011 Liu
8,082,717 B2 12/2011 Dammers
8,166,718 B2 5/2012 Liu
8,245,477 B2 8/2012 Pervan
8,261,507 B2 9/2012 Hahn et al.
8,375,674 B2 2/2013 Braun et al.
8,381,488 B2 2/2013 Pervan
8,397,456 B2 3/2013 Ruhdorfer
8,419,877 B2 4/2013 Pervan et al.
8,484,924 B2 7/2013 Braun
8,490,361 B2 7/2013 Curry et al.
8,544,232 B2 10/2013 Wybo et al.
8,720,151 B2 5/2014 Pervan
8,784,587 B2 7/2014 Lindgren et al.
8,828,175 B2 9/2014 Roy
8,839,584 B2 9/2014 Sokol
8,850,769 B2 10/2014 Pervan
8,875,464 B2 11/2014 Pervan et al.
8,935,899 B2 1/2015 Bergelin et al.
9,140,010 B2 9/2015 Pervan
9,194,135 B2 11/2015 Pervan
9,222,267 B2 12/2015 Bergelin et al.
9,314,936 B2 4/2016 Pervan
9,482,015 B2 11/2016 Pervan
9,487,957 B2 11/2016 Cappelle
9,556,623 B2 1/2017 Pervan
9,663,956 B2 5/2017 Pervan
9,714,515 B2 7/2017 Pervan
9,758,966 B2 9/2017 Bergelin et al.
9,758,972 B2 9/2017 Pervan
9,840,849 B2 12/2017 Pervan
10,066,400 B2 9/2018 Pervan
10,619,356 B2 4/2020 Pervan
10,669,724 B2 6/2020 Pervan
10,723,147 B2 7/2020 Pervan et al.
10,988,901 B2 4/2021 Pervan
11,002,022 B2 5/2021 Pervan
11,377,855 B2 * 7/2022 Josefsson ..... E04F 13/0894
2002/0007608 A1 1/2002 Pervan
2002/0007609 A1 1/2002 Pervan
2002/0100231 A1 8/2002 Miller
2002/0170258 A1 11/2002 Schwitte et al.
2003/0009971 A1 1/2003 Palmberg
2003/0037504 A1 2/2003 Schwitte
2003/0101681 A1 6/2003 Tychsen
2003/0233809 A1 12/2003 Pervan
2004/0211143 A1 10/2004 Hanning
2004/0211144 A1 10/2004 Stanchfield
2004/0226243 A1 11/2004 Lin et al.
2004/0255538 A1 12/2004 Ruhdorfer
2005/0005558 A1 1/2005 Bolduc
2005/0069674 A1 3/2005 Chang
2005/0102937 A1 5/2005 Pervan
2005/0108969 A1 5/2005 Whitaker
2005/0138881 A1 6/2005 Pervan
2005/0208255 A1 9/2005 Pervan
2005/0268571 A1 12/2005 Magnusson
2006/0179773 A1 8/2006 Pervan
2006/0191226 A1 8/2006 Kim et al.
2006/0194015 A1 8/2006 Sabater et al.
2007/0006543 A1 1/2007 Engström
2007/0175148 A1 8/2007 Bergelin et al.
2007/0193180 A1 8/2007 Plante
2007/0292656 A1 12/2007 Handojo
2008/0005992 A1 1/2008 Pervan
2008/0008871 A1 1/2008 Pervan
2008/0010937 A1 1/2008 Pervan
2008/0092473 A1 4/2008 Heyns
2008/0110125 A1 5/2008 Pervan
2008/0184647 A1 8/2008 Yau
2009/0155612 A1 6/2009 Pervan et al.
2009/0183458 A1 7/2009 Gibson et al.
2009/0193748 A1 8/2009 Boo et al.
2009/0269522 A1 10/2009 Liu
2010/0088990 A1 4/2010 Liu
2010/0129611 A1 5/2010 Sugimoto
2011/0030303 A1 2/2011 Pervan et al.
2011/0167744 A1 * 7/2011 Whispell ..... E04F 15/105 52/309.1
2011/0247285 A1 10/2011 Wybo
2011/0308097 A1 12/2011 Vollrath
2012/0124932 A1 5/2012 Schulte et al.
2012/0266555 A1 10/2012 Cappelle
2012/0279158 A1 11/2012 Konstanczak
2013/0047536 A1 2/2013 Pervan
2013/0065072 A1 3/2013 Pervan
2013/0145707 A1 6/2013 Pervan
2013/0199120 A1 8/2013 Bergelin et al.
2013/0260089 A1 * 10/2013 Gorby ..... C04B 38/0006 428/116
2013/0273244 A1 10/2013 Vetter et al.
2013/0283720 A1 10/2013 Pervan et al.
2014/0000197 A1 * 1/2014 Pervan ..... E04F 15/102 52/309.1
2014/0196618 A1 7/2014 Pervan et al.
2014/0215952 A1 8/2014 Pervan
2014/0283466 A1 9/2014 Boo
2015/0059927 A1 3/2015 Brännström et al.
2015/0090400 A1 4/2015 Bergelin et al.
2015/0210055 A1 * 7/2015 Pervan ..... C09D 11/38 524/388
2015/0284964 A1 10/2015 Yau
2015/0345153 A1 12/2015 Pervan
2016/0069089 A1 3/2016 Bergelin
2016/0168865 A1 6/2016 Pervan
2016/0194883 A1 7/2016 Pervan
2016/0201336 A1 7/2016 Pervan
2016/0208501 A1 7/2016 Pervan
2016/0250835 A1 9/2016 Pervan
2016/0265234 A1 9/2016 Pervan

(56) References Cited

U.S. PATENT DOCUMENTS

| | | | |
|---|---|---|---|
| 2016/0265236 | A1 | 9/2016 | Pervan |
| 2016/0340910 | A1 | 11/2016 | Ramachandra |
| 2016/0369507 | A1* | 12/2016 | Pervan ..... B32B 38/08 |
| 2017/0009462 | A1 | 1/2017 | Muehlebach |
| 2017/0114550 | A1 | 4/2017 | Pervan |
| 2017/0268238 | A1 | 9/2017 | Pervan |
| 2018/0080232 | A1 | 3/2018 | Pervan |
| 2018/0223540 | A1 | 8/2018 | Cappelle |
| 2018/0313094 | A1 | 11/2018 | Pervan |
| 2018/0355620 | A1 | 12/2018 | Pervan |
| 2019/0024390 | A1 | 1/2019 | Yasuda et al. |
| 2019/0292793 | A1 | 9/2019 | Van Vlassenrode et al. |
| 2020/0123788 | A1 | 4/2020 | Baert et al. |
| 2020/0208411 | A1 | 7/2020 | Pervan |
| 2020/0282589 | A1 | 9/2020 | Joseffson et al. |
| 2020/0284049 | A1 | 9/2020 | De Rick |
| 2020/0308846 | A1 | 10/2020 | Joseffson et al. |
| 2021/0032877 | A1 | 2/2021 | Pervan |
| 2021/0123244 | A1 | 4/2021 | Bouckéet al. |
| 2021/0198901 | A1 | 7/2021 | Josefsson et al. |
| 2021/0363760 | A1 | 11/2021 | Pervan |
| 2021/0372143 | A1* | 12/2021 | Baert ..... E04F 15/08 |
| 2022/0063167 | A1 | 3/2022 | Joseffson et al. |
| 2022/0290444 | A1* | 9/2022 | Josefsson ..... E04F 13/0866 |
| 2022/0314503 | A1 | 10/2022 | Josefsson et al. |

FOREIGN PATENT DOCUMENTS

| | | | |
|---|---|---|---|
| DE | 295 21 221 | U1 | 3/1997 |
| DE | 100 49 172 | A1 | 4/2002 |
| DE | 103 00 451 | B3 | 1/2004 |
| DE | 10 2005 061 099 | A1 | 3/2007 |
| DE | 10 2006 024 184 | A1 | 11/2007 |
| DE | 10 2007 032 885 | A1 | 1/2009 |
| EP | 2 206 851 | A2 | 7/2010 |
| EP | 2 339 092 | A1 | 6/2011 |
| EP | 2 395 180 | A2 | 12/2011 |
| EP | 2 520 737 | A1 | 11/2012 |
| EP | 2 520 737 | B1 | 11/2012 |
| EP | 3 415 702 | A1 | 12/2018 |
| EP | 3 511 485 | A1 | 7/2019 |
| ES | 2 350 339 | A1 | 1/2011 |
| FI | 21805 | | 1/1947 |
| GB | 519198 | | 3/1940 |
| JP | S56-9114 | A | 1/1981 |
| JP | S62-178654 | A | 8/1987 |
| JP | H03-47366 | A | 2/1991 |
| JP | H03-55444 | U | 5/1991 |
| JP | H06-158831 | A | 6/1994 |
| JP | H08-28015 | A | 1/1996 |
| JP | H09-38906 | A | 2/1997 |
| JP | H10-299231 | A | 11/1998 |
| JP | H11-324292 | A | 11/1999 |
| JP | 2000-265652 | A | 9/2000 |
| JP | 2003-307023 | A | 10/2003 |
| JP | 2004-225387 | A | 8/2004 |
| JP | 2006-118337 | A | 5/2006 |
| JP | 2019-025589 | A | 2/2019 |
| RU | 2359093 | C2 | 6/2009 |
| WO | WO 96/06248 | A1 | 2/1996 |
| WO | WO 99/00242 | A1 | 1/1999 |
| WO | WO 01/48333 | A1 | 7/2001 |
| WO | WO 03/087498 | A1 | 10/2003 |
| WO | WO 2009/065769 | A2 | 5/2009 |
| WO | WO 2009/116926 | A1 | 9/2009 |
| WO | WO 2010/081532 | A1 | 7/2010 |
| WO | WO 2011/012104 | A2 | 2/2011 |
| WO | WO 2014/136128 | A1 | 9/2014 |
| WO | WO 2018/068197 | A1 | 4/2018 |
| WO | WO 2021/018918 | A1 | 2/2021 |

OTHER PUBLICATIONS

U.S. Appl. No. 17/705,465, Per Josefsson and Christoffer Nilsson, filed Mar. 28, 2022, (Cited herein as US Patent Application Publication No. 2022/0314503 A1 of Oct. 6, 2022).

Pervan, U.S. Appl. No. 17/812,281 entitled "Mechanical Locking System for Floor Panels", filed Jul. 13, 2022.

U.S. Appl. No. 17/463,902, Per Josefsson, filed Sep. 1, 2021.

U.S. Appl. No. 17/705,465, Per Josefsson, filed Mar. 28, 2022.

U.S. Appl. No. 18/055,473, Per Josefsson, filed Nov. 15, 2022.

U.S. Appl. No. 18/209,359, Per Josefsson, filed Jun. 13, 2023.

U.S. Appl. No. 18/209,667, Per Josefsson, filed Jun. 14, 2023.

U.S. Appl. No. 18/210,429, Per Josefsson, filed Jun. 15, 2023.

U.S. Appl. No. 18/495,918, Per Josefsson, filed Oct. 27, 2023.

U.S. Appl. No. 16/808,973, Per Josefsson and Richard Jolfson, filed Mar. 4, 2020, (Cited herein as US Patent Application Publication No. 2020/0282589 A1 of Sep. 10, 2020).

U.S. Appl. No. 16/854,343, Darko Pervan, filed Apr. 21, 2020, (Cited herein as US Patent Application Publication No. 2021/0032877 A1 of Feb. 4, 2021).

U.S. Appl. No. 17/130,783, Per Josefsson, Christoffer Nilsson, Filip Sköld, filed Dec. 22, 2020, (Cited herein as US Patent Application Publication No. 2021/0198901 A1 of Jul. 1, 2021).

U.S. Appl. No. 17/228,240, Darko Pervan, filed Apr. 12, 2021, (Cited herein as US Patent Application Publication No. 2021/0363760 A1 of Nov. 25, 2021).

U.S. Appl. No. 17/463,902, Per Josefsson, Martin Bjeremyr, Richard Jolfson, filed Sep. 1, 2021, (Cited herein as US Patent Application Publication No. 2022/0063167 A1 of Mar. 3, 2022).

U.S. Appl. No. 17/705,465, Per Josefsson and Christoffer Nilsson, filed Mar. 28, 2022.

International Search Report and Written Opinion issued in PCT/SE2020/050302, dated Jun. 10, 2020, Patent—och registreringsverket, Stockholm, SE, 15 pages.

Pervan, Darko (Author)/Valinge Innovation, Technical Disclosure entitled "VA073a Zip Loc," Sep. 13, 2011, IP.com No. IPCOM000210869D, IP.com PriorArtDatabase, 36 pages (XP055191930).

Josefsson, Per, et al., U.S. Appl. No. 17/705,465 entitled "Method and Assembly for Manufacturing a Board Element Comprising a Recycled Material," filed Mar. 28, 2022.

U.S. Appl. No. 18/425,012, Per Josefsson, filed Jan. 29, 2024.

* cited by examiner

MINERAL-BASED PANEL COMPRISING GROOVES AND A METHOD FOR FORMING GROOVES

CROSS REFERENCE TO RELATED APPLICATIONS

The present application is a continuation of U.S. application Ser. No. 16/826,761, filed on Mar. 23, 2020, now U.S. Pat. No. 11,377,855, which claims the benefit of Swedish Application No. 1950364-8, filed on Mar. 25, 2019. The entire contents of each of U.S. application Ser. No. 16/826,761 and Swedish Application No. 1950364-8 are hereby incorporated herein by reference in their entirety.

TECHNICAL FIELD

The disclosure generally relates to a mineral-based panel. More specifically, the disclosure relates to a mineral-based panel comprising a mineral-based core, wherein the panel comprises at least one groove, preferably a plurality of grooves. The disclosure also relates to a method for forming such grooves in a mineral-based panel. The mineral-based panel may be a building panel, floor panel, wall panel, ceiling panel or furniture panel. Optionally, the panel may comprise a locking system on at least one edge portion of the panel, preferably on two opposite edge portions of the panel. The disclosure also relates to a locking system in a mineral-based panel comprising a mineral-based core and polymer-based lower layer(s).

BACKGROUND

There is an increased demand for boards, such as floor boards, that are sustainable and in particular recyclable. There is also a need for fire resistant and water resistant boards, especially those that may maintain or even improve the properties that typically are associated with the boards, such as their dimensional stability under temperature variations of the ambient temperature and/or under moisture variations and, optionally, their flexibility.

Examples of such boards are magnesium oxide boards and cement boards or fibre cement boards. For example, a magnesium oxide board may have a layer structure attached thereto, such as comprising HPL panel.

However, such boards are still typically relatively heavy and there is need for improvements. Moreover, there is need for more robust locking systems for such, and similar, boards.

SUMMARY

It is therefore an object of at least embodiments of the present inventive concept to provide a mineral-based panel having a reduced weight and/or material content.

It is also an object of at least embodiments of the present inventive concept to reduce cost in producing such panels.

Additionally, it is an object of at least embodiments of the present inventive concept to provide a method for forming such grooves in a mineral-based panel.

It is also an object of at least embodiments of the present inventive concept to regulate, such as improve, sound properties of the mineral-based panel.

Another object of at least embodiments of the present inventive concept is to provide an improved locking system for a mineral-based panel.

At least some of these and other objects and advantages that will be apparent from the description have been achieved by the various aspects described below.

In accordance with a first aspect of the inventive concept, there is provided a mineral-based panel, such as a floor panel, comprising a mineral-based core, wherein the panel comprises at least one groove, preferably a plurality of grooves.

The mineral-based panel may be a floor panel, a building panel, a wall panel, a ceiling panel or a furniture panel.

The panel may comprise a front side and a rear side. The front side may be a visible side of the panel and the rear side may be concealed in an installed state of the panel, such as facing a subfloor, a subroof or a subwall.

A thickness of the panel may be 2-40 mm, such as 4-12 mm or 2-10 mm. For example, a floor panel may have a thickness of 2-10 mm. A groove length of each groove may be larger than 5 mm, preferably larger than 50 mm.

The mineral-based panel may be a cementitious panel comprising cement. For example, the mineral-based core, or core for short, may be a cementitious core.

The cementitious panel or core may comprise non-hydraulic cement. The non-hydraulic cement may comprise magnesium oxide, and optionally magnesium chloride (e.g. $MgCl_2$) and/or magnesium sulphate (e.g. $MgSO_4$). For example, the non-hydraulic cement may comprise or may be Sorel cement.

The cementitious panel or core may comprise hydraulic cement. The hydraulic cement may comprise silicates, such as calcium silicates, and optionally oxides. For example, the cement may be fibre cement, such as comprising or being Portland cement.

The at least one groove may be provided in a rear side of the panel.

The at least one groove may be provided in a lower side of the mineral-based core.

The at least one groove may be provided in an upper side of the mineral-based core.

The mineral-based core may comprise magnesium oxide and, optionally, magnesium chloride and/or magnesium sulphate.

The mineral-based core may comprise gypsum or may be a gypsum board. This may be particularly advantageous for a wall panel or a ceiling panel.

The mineral-based core may comprise an inorganic matrix material. For example, the inorganic matrix material may comprise magnesium oxide, cement, such as hydraulic or non-hydraulic cement, or gypsum, preferably in an amount of at least 20 wt %, such as at least 30 wt %.

Generally, the core may further comprise at least one selected from the group of a filler, such as an organic and/or inorganic filler, additive(s) and a binding agent. The filler may be a functional filler. For example, the functional filler may reinforce the core, improve the bonding to a, preferably inorganic, matrix material of the core, increase a rigidity of the core, etc.

The core may comprise organic material, such as at least one selected from the group of wood fibres, cellulose fibres, natural fibres, carbon fibres, and bamboo.

The core may comprise inorganic material, such as calcium carbonate, fly ash, silica, or perlite.

The mineral-based core may comprise cement.

The mineral-based core may comprise reinforcing material, such as fibre reinforcement. The fibre reinforcement may be organic, such as comprising cellulose fibres or wood fibres, or inorganic, such as comprising glass fibres.

The mineral-based core may be a cement board, such as a fibre cement board.

Generally, a density of the mineral-based core, for example comprising magnesium oxide or cement, may be between 1000 and 2000 kg/m$^3$, such as between 1200 and 1700 kg/m$^3$. A larger density may provide a larger rigidity and/or a larger flexural rigidity of the core.

The mineral-based panel may further comprise a lower arrangement comprising at least one lower layer which is attached to a lower side of the mineral-based core.

The at least one groove may be at least partly provided in the lower arrangement, such as the at least one groove fully penetrating at least one lower layer of the lower arrangement.

At least two lower layers may be attached together by means of an adhesive or may be laminated together, or a combination thereof. The adhesive may be compatible with the materials of the attached layers.

In a first example, the lower arrangement may be attached to the core by means of an adhesive. In a second example, the lower arrangement may be laminated to the core.

The lower arrangement may comprise a backing layer, which preferably is a bottommost layer of the lower arrangement. The backing layer may impact the balancing properties and/or the stability of the panel.

The material content of any, some or each lower layer may be the same as in the core, whereby reference is made to the above.

In any of the embodiments herein, a density of at least one lower layer, such as all lower layers, in the lower arrangement may be larger than a density of the mineral-based core. Generally, the density may be between 1100 and 2100 kg/m$^3$, such as between 1300 and 1400 kg/m$^3$.

At least one lower layer in the lower arrangement, preferably all lower layers, may comprise magnesium oxide and, optionally, magnesium chloride and/or magnesium sulphate. Each such lower layer may comprise an inorganic matrix material. For example, the inorganic matrix material may comprise magnesium oxide, cement, such as hydraulic or non-hydraulic cement, or gypsum, preferably in an amount of at least 20 wt %, such as at least 30 wt %.

At least one lower layer in the lower arrangement, preferably all lower layers, may comprise cement.

The at least one lower layer may be a cement board, such as a fibre cement board.

The lower arrangement may comprise at least one polymer-based layer, such as at least one thermoplastic layer, for example comprising polyvinyl chloride (PVC), polyethylene (PE), thermoplastic polyurethane (TPU), polypropylene (PP), polyethylene terephthalate (PET), polyolefin copolymers or acrylonitrile butadiene styrene (ABS), or at least one thermosetting layer, for example comprising a melamine-formaldehyde resin, or melamine resin for short, epoxy resin, preferably crosslinked with an amine hardener, polyurethane (PU), polyurea or acrylate polymers.

The lower arrangement may comprise at least one wood-based layer or cellulose-based layer, such as a veneer, paper, such as impregnated paper, preferably paper impregnated with a melamine resin, solid wood layer, MDF layer, HDF layer, layer of Direct Pressure Laminate (DPL) or High Pressure Laminate (HPL), or particle board layer.

The mineral-based panel may further comprise an upper arrangement comprising at least one upper layer and which is attached to an upper side of the mineral-based core.

At least two upper layers may be attached together by means of an adhesive or may be laminated together, or a combination thereof. The adhesive may be compatible with the materials of the attached layers.

In a first example, the upper arrangement may be attached to the core by means of an adhesive. In a second example, the upper arrangement may be laminated to the core.

In any of the embodiments and examples herein, the adhesive attaching a first structure to a second structure, may be a polyurethane, silane-terminated epoxy resin, or silane-terminated polyurethane. Any of these may be two component. Moreover, the adhesive may be a non-reactive or reactive hot-melt adhesive, for example being based on polyurethane or polyolefin. More generally, the adhesive may be a two-component adhesive. Preferably, the adhesive is moisture resistant and/or heat resistant.

The material content of any, some or each upper layer may be the same as in the core, whereby reference is made to the above.

In any of the embodiments herein, a density of at least one upper layer, such as all upper layers, in the upper arrangement may be larger than a density of the mineral-based core.

Generally, the density may be between 1100 and 2100 kg/m$^3$, such as between 1300 and 1400 kg/m$^3$.

At least one upper layer in the upper arrangement, preferably all upper layers, may comprise magnesium oxide and, optionally, magnesium chloride and/or magnesium sulphate. Each such upper layer may comprise an inorganic matrix material. For example, the inorganic matrix material may comprise magnesium oxide, cement, such as hydraulic or non-hydraulic cement, or gypsum, preferably in an amount of at least 20 wt %, such as at least 30 wt %.

At least one upper layer in the upper arrangement, preferably all upper layers, may comprise cement.

The at least one upper layer may be a cement board, such as a fibre cement board.

The upper arrangement may comprise at least one polymer-based layer, such as at least one thermoplastic layer, for example comprising PVC, PE, TPU, PP, PET or ABS, or at least one thermosetting layer, for example comprising a melamine-formaldehyde resin, epoxy resin, preferably crosslinked with an amine hardener, PU, polyurea or acrylate polymers.

In a first example, the upper and lower arrangements may comprise the same polymer-based material compositions, such as being provided with the core in an ABA layered structure. In a second example, the upper and lower arrangements may comprise different polymer-based material compositions, such as being provided with the core in an ABC layered structure. For example, the core ("layer B") may comprise magnesium oxide and the upper and lower arrangements may each comprise a thermoplastic material and, preferably, a filler.

The upper arrangement may comprise at least one wood-based layer or cellulose-based layer, such as a veneer, paper, such as impregnated paper, preferably paper impregnated with a melamine resin, solid wood layer, MDF layer, HDF layer, or particle board layer.

The at least one polymer-based layer of the upper and/or lower arrangement(s) may comprise plasticized and/or flexible layer(s), such as being a Luxury Vinyl Tile (LVT) panel or an LVT sheet. Alternatively, the at least one polymer-based layer of the upper and/or lower arrangement(s) may comprise rigid layer(s), such as being a Stone Plastic (Polymer) Composite (SPC) panel or an SPC sheet.

The at least one polymer-based layer of the upper and/or lower arrangement(s) may be a powder-based layer comprising a thermosetting resin, optionally further comprising at least one veneer layer.

The at least one wood-based or cellulose-based layer of the upper and/or lower arrangement(s) may be a high-pressure laminate (HPL) panel.

The at least one wood-based or cellulose-based layer of the upper and/or lower arrangement(s) may be a powder-based separate surface layer (SSL) as described in WO 2009/065769 A2. For example, the SSL layer may have a thickness of about 0.3-3.0 mm. The surface layer may have a high density and impact resistance even if it is combined with rather soft core materials.

In some embodiments, the upper arrangement may comprise at least one ceramic tile, for example attached to a carrier layer of the upper arrangement or to the core by an adhesive.

The upper arrangement and/or the lower arrangement(s) may be rigid. For example, the upper arrangement and/or the lower arrangement(s) may be more rigid than the core.

At least one upper and/or lower layer may comprise a filler. The filler may be a filler, such as a functional filler, in complete analogy with any of the embodiments of the filler of the core described elsewhere herein.

The upper arrangement and/or the lower arrangement(s) may be soft. For example, the upper arrangement and/or the lower arrangement may be softer than the core. In any embodiment of the upper and/or lower arrangement(s), any, some or all lower and/or upper layer(s) may comprise a plasticizer. This may be particularly relevant for thermoplastic layers. If so, an adhesive which is compatible with a plasticizer may be preferred.

In a first example, the upper and/or lower arrangement(s) may be balanced per se. Thereby, a balanced panel may be obtained. In a second example, the panel may be balanced by providing a lower and an upper arrangement.

The at least one groove may be provided in the core, wherein the core is provided between an upper and a lower arrangement. For example, the upper and a lower arrangement may each comprise a polymer-based material, such as a thermoplastic material and, preferably, a filler.

The mineral-based panel may further comprise a top structure provided on, such as attached to, an upper side of the mineral-based core or provided on, such as attached to, an upper arrangement of the mineral-based panel, the top structure preferably comprising a décor layer.

The top structure may comprise or may be a top layer.

The décor layer may comprise a printed décor, such as a digitally printed décor. For example, the printed décor may be provided directly on the upper side of the core or directly on the upper arrangement. Optionally, a primer, such as a UV primer, may be provided on the core or the upper arrangement under the printed décor.

The décor layer may comprise a print film.

The top structure may comprise a coating layer, such as a UV curable coating layer, a lacquer or a hot-melt coating layer, and/or a wear layer, such as comprising aluminium oxide, a thermoplastic film, or a thermosetting resin, such as a melamine resin. The thermoplastic film may comprise PVC, PU, TPU or PET.

In a first example, the coating layer and/or wear layer is provided on the upper arrangement, optionally comprising a décor layer. In a second example, the coating layer and/or wear layer is provided on the mineral-based core, optionally comprising a décor layer.

The mineral-based panel may further comprise a cover layer. The cover layer may at least partly, preferably completely, cover the grooves. The cover layer may be attached to a lower side of the core or to the lower arrangement, such as a lowermost lower layer thereof.

Preferably, the cover layer is continuous and thereby does not comprise any openings or grooves. However, it is equally conceivable that the cover layer is discontinuous, such as comprising openings.

For example, the cover layer may be a flexible layer, such as a foam layer. In non-restrictive examples, the cover layer may comprise an irradiated cross-linked polyethylene (IXPE) foam, Ethylene Vinyl Acetate (EVA) foam, foam rubber, cork, a natural material, or Polyurethane (PU) foam.

The mineral-based panel may further comprise at least one reinforcement layer, such as a glass-fibre layer. Generally, at least one woven or nonwoven reinforcement layer may be used.

The at least one reinforcement layer may be a metal-based layer, such as a mesh, for example comprising steel. This may be particularly advantageous for a panel, such as a core, comprising cement.

Any, some or each of the at least one reinforcement layer may be a mesh, such as a glass-fibre mesh.

At least one reinforcement layer may be provided between the core and an upper arrangement of the panel and/or between the core and a lower arrangement of the panel.

The at least one reinforcement layer may be provided in the mineral-based core, for example in a centre portion of the core.

At least one reinforcement layer may be positioned in a top portion and/or a bottom portion of the mineral-based core. In a first example, at least one reinforcement layer may be positioned a distance from an upper and/or a lower side of the core which is less than 1/6, preferably less than 1/8, more preferably less than 1/16, of a thickness of the core. In a second example, at least one reinforcement layer may be positioned a distance from an upper and/or a lower side of the core which is less than 2 mm, such as less than 1 mm. A thickness of the core may be 2-40 mm, such as 4-12 mm or 2-10 mm. In a third example, at least one reinforcement layer may be positioned essentially at the upper and/or lower side of the core.

Alternatively or additionally to reinforcement layers, the core may comprise reinforcing material, such as fibre reinforcement or, more generally, separate reinforcement particles. The fibre reinforcement may be organic, such as comprising wood fibres or cellulose fibres, or inorganic, such as comprising glass fibres.

The at least one reinforcement layer may be provided in the upper and/or the lower arrangement(s).

The at least one groove may be provided spaced from, such as below, the at least one reinforcement layer. Thereby, the at least one reinforcement layer may be left intact. In some embodiments, however, the at least one groove may be provided through the at least one reinforcement layer.

In some embodiments, the core or a lower layer, such as a bottommost layer, of the lower arrangement may comprise separate reinforcement particles and the at least one groove may be provided in the lower layer or the core only. For example, the at least one groove may be provided below each of the at least one reinforcement layer. Thereby, the panel may be reinforced while reducing the weight of the panel.

The at least one reinforcement layer may be positioned in a top portion and/or a bottom portion of any lower layer and/or upper layer. The first, second and third examples described above in relation to the core are valid also for the lower layer and/or upper layer, whereby reference is made thereto.

Generally, any, some, or all of the lower and/or upper layer(s) in any of the embodiments described herein may comprise reinforcing material, such as fibre reinforcement or, more generally, separate reinforcement particles. The fibre reinforcement may be organic, such as comprising cellulose fibres or wood fibres or cellulose fibres, or inorganic, such as comprising glass fibres. Moreover, the lower and/or upper arrangement(s) may comprise sound-dampening fillers. Alternatively, or additionally, the core may comprise sound-dampening fillers.

In some embodiments, such as when the panel is a floor panel, the panel may be configured to be installed in a floor system, such as a floating floor system. In some embodiments, no horizontal or vertical mechanical locking system may be provided in the panel. For example, the panel may be configured to be nailed or glued to a subfloor. In another example, the panel may be configured to be installed loosely on a subfloor without any mechanical locking system.

In some embodiments, the panel, such as a floor panel or a wall panel, may comprise a locking system and may be configured to be locked to an adjacent panel by angling of the panel and/or by a vertical displacement V of the panel, such as a so-called fold-down system.

In some embodiments, the panel, such as a floor panel or a wall panel, may comprise a locking system comprising a tongue and groove configuration and/or may be configured to be locked to other panels by separate clips.

In some embodiments, the panel, such as a ceiling panel, may be configured to be installed in a grid of profiles.

The vertical locking system, such as on long and/or short edge portions, may be integrally formed with the panel.

The mineral-based panel may further comprise a locking system, such as a mechanical locking system, for horizontal and/or vertical locking. Thereby, the panel may be locked to adjacent panels of a similar type.

The locking system may be a locking system on a first pair and a second pair of opposite edge portions of the panel, the first pair preferably comprising long edge portions of the panel and the second pair preferably comprising short edge portions thereof.

Any horizontal locking system may comprise a locking element and a locking groove, and/or any vertical locking system may comprise a tongue and a tongue groove. Alternatively, or additionally, the locking element and locking groove may comprise vertical locking surfaces configured to cooperate for vertical locking. In a first example, the tongue is integrally formed with the panel, preferably with the core. This is conceivable on a long and/or a short edge portion. In a second example, and as preferred on a short edge portion, the tongue is separately formed from the panel, and may be provided in a displacement groove provided in the panel, preferably in the core.

The mineral-based panel may comprise a plurality of grooves, wherein at least two grooves have different characteristics, such as groove depths and/or groove widths. Alternatively, or additionally, a cross-sectional shape and/or a groove length of at least two grooves may be different.

In some embodiments, at least two grooves, preferably all grooves, have the same characteristics, such as groove depths and/or groove widths. Alternatively, or additionally, a cross-sectional shape and/or a groove length of the at least two grooves may be the same.

In any of the embodiments herein, a groove depth may be at least 0.2, such as 0.3, preferably 0.4, times a thickness of the panel.

The at least one groove may comprise an opening having a groove width that is larger than a groove width of an inner part of the at least one groove.

The at least one groove may be provided in an interior of the panel, such as in the rear side of the panel, thereby being spaced from a pair of opposite edge portions, such as opposite short edge portions, of the panel, preferably being spaced from all edge portions of the panel.

The at least one groove may be provided inwardly of a locking system on a first pair and/or a second pair of opposite edges of the panel. For example, a groove length of at least one groove, preferably all grooves, may be smaller than a distance between the locking systems at opposite short edge portions.

The at least one groove may extend to at least one edge portion, such as two edge portions, of a pair of opposite edge portions, such as opposite short edge portions, of the panel. For example, the at least one groove may extend to an edge portion comprising a locking groove.

At least one groove may be provided below an underside of an edge portion comprising a locking groove.

A shape of one or both end portions of the at least one groove along its longitudinal direction may be curved.

One end portion or both end portions may be parallel with a front side of the panel, preferably such that they intersect at least a portion of the strip and/or at least a portion of the locking groove.

The panel may be rectangular with long edge portions and short edge portions, wherein the at least one groove, such as its longitudinal direction, is parallel with the long edge portions.

The panel may be rectangular with long edge portions and short edge portions, wherein the at least one groove, such as its longitudinal direction, is parallel with the short edge portions.

The at least one groove may be continuous, preferably being parallel with long edge portions of the panel.

The at least one groove may be discontinuous, preferably being parallel with long edge portions of the panel.

The mineral-based panel may comprise at least two groove arrangements, such as a plurality of groove arrangements, wherein adjacent pairs of groove arrangements preferably are separated by a separation portion.

An area of the of a surface in which the at least one groove is provided, such as the rear side or the lower and/or upper side of the core, may be less than 90%, such as less than 80%, of an area of a front side of the panel. Alternatively, or additionally, a volume of the groove(s) may be at least 5 vol %, such as at least 10 vol %, preferably 5-30 vol %, such as 10-20 vol %. The volume may be a volume occupied by the groove(s) within the panel, such as being limited by a horizontal plane provided along the rear side. When the grooves are internal grooves, preferably being provided in the core, the volume may be a volume occupied by the grooves within the panel.

In accordance with a second aspect of the inventive concept, there is provided a set of panels comprising a plurality of panels in accordance with any of the embodiments or examples of the first aspect. The details and advantages as well as embodiments and examples of the second aspect are largely analogous to those of the first aspect, wherein reference is made thereto.

In accordance with a third aspect of the inventive concept, there is provided a method for forming at least one groove in a mineral-based panel, such as a floor panel, comprising: arranging the panel on a support member, and forming at least one groove in the panel by removing material, such as chips, from the panel. The details and advantages as well as embodiments and examples of the third aspect are largely analogous to those of the first aspect, wherein reference is made thereto. In addition, at least the following embodiments are conceivable.

The at least one groove may be provided in a rear side of the panel.

The at least one groove may be formed by rotational processing with at least one tooth element, such as by a rotating cutting device.

The at least one groove may be formed by non-rotational processing with at least one tooth element, such as by carving, preferably using a carving tool.

The method may further comprise forming a locking system, such as a mechanical locking system, for horizontal and/or vertical locking of the mineral-based panel.

In accordance with a fourth aspect of the inventive concept, there is provided a mineral-based panel, such as a floor panel, comprising a mineral-based core and a lower arrangement comprising at least one polymer-based lower layer, wherein the lower arrangement is attached to a lower side of the mineral-based core. The mineral-based panel further comprises a locking system for horizontal and/or vertical locking, wherein the locking system comprises a strip extending horizontally beyond an upper portion of the mineral-based panel. At least a horizontal portion of the strip is entirely formed in the lower arrangement.

Thereby, especially when, but not limited to, the polymer-based lower layer is a thermoplastic layer, the strip may become more flexible. A risk of damaging or breaking the strip during locking of the panel to an adjacent panel may be reduced. Additionally, the locking system and hence the panel may become more resistant to heavy loads. It is emphasized that the fourth aspect is equally applicable to a panel without any groove(s) being formed therein.

The strip may extend from vertical plane VP defined by immediately juxtaposed upper portions of two neighboring joint edge portions of two joined panels. The strip may be a strip at a short edge portion and/or at a long edge portion. Optionally, the strip may comprise a lower panel portion provided below the tongue groove.

The horizontal portion may extend along a first and/or a second horizontal direction of the mineral-based panel and may have a vertical extension, such as extending from a rear side of the panel to an upper surface of the strip.

The strip may comprise a locking element. Preferably, the horizontal portion is at least provided horizontally inwardly of the locking element.

The horizontal portion may comprise the entire strip, preferably including a locking element.

The locking element may comprise a portion of the mineral-based core, such as at a distal end portion of the locking element. The distal end portion may be a vertical distal end portion.

A horizontal and/or a vertical locking surface may be provided in the lower arrangement.

Alternatively, or additionally, a horizontal and/or a vertical locking surface may be provided in the upper arrangement, which preferably also comprises at least one polymer-based layer, such as a thermoplastic layer. Thereby, by analogy with the discussion above, the portion of the panel comprising said vertical locking surface may become more flexible and consequently more resistant to damage or breaking, etc.

The horizontal locking system may comprise a locking element and a locking groove and/or the vertical locking system may comprise a tongue and a tongue groove. Hence, a horizontal locking surface may be provided on the locking element and locking groove and/or a vertical locking surface may be provided on the tongue and tongue groove. Alternatively, or additionally, the locking element and locking groove may comprise vertical locking surfaces configured to cooperate for vertical locking.

Generally, a locking surface may be configured to lock two adjacent panels in one direction. Therefore, the horizontal and vertical locking system preferably comprises at least a pair of horizontal locking surfaces and at least a pair of vertical locking surfaces be configured to lock two adjacent panels in two opposite horizontal and vertical directions, respectively. In some embodiments, the horizontal and vertical locking surfaces may be provided by a common, preferably inclined, surface.

A horizontal extension of the tongue from a vertical plane may be smaller than an extension of the strip from a vertical plane. A horizontal extension of the tongue groove may be substantially the same as the extension of the tongue.

The mineral-based panel may further comprise an upper arrangement comprising at least one upper layer being attached to an upper side of the mineral-based core.

Embodiments of the material composition of each of the core and the lower arrangement comprising polymer-based layer(s), and optionally the upper arrangement, preferably comprising at least one polymer-based layer, may be the same as those of the first aspect, whereby reference is made thereto. Reference is also made thereto for embodiments of the top structure and/or reinforcement layer(s).

Other embodiments and examples of the fourth aspect, such as embodiments of optional groove(s), may be the same as those of the first aspect, wherein reference is made thereto.

Further aspects of the inventive concept and embodiments and examples of each of the first, second and third aspects are provided in an embodiment section below. It is emphasized that the embodiments and examples of any aspect herein, including the fourth aspect, may be combined with embodiments and examples of any other aspect.

Generally, all terms used in the claims and in the items in the embodiment section below are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise.

BRIEF DESCRIPTION OF THE DRAWINGS

The disclosure will in the following be described in connection to exemplary embodiments and in greater detail with reference to the appended exemplary drawings, wherein.

DETAILED DESCRIPTION

Next, various embodiments of a panel 1 is described with reference to the embodiments in FIGS. 1*a*-1*c*, 2*a*-2*e*, 3*a*-3*g* and 4*a*-4*g*.

Figure 1A:
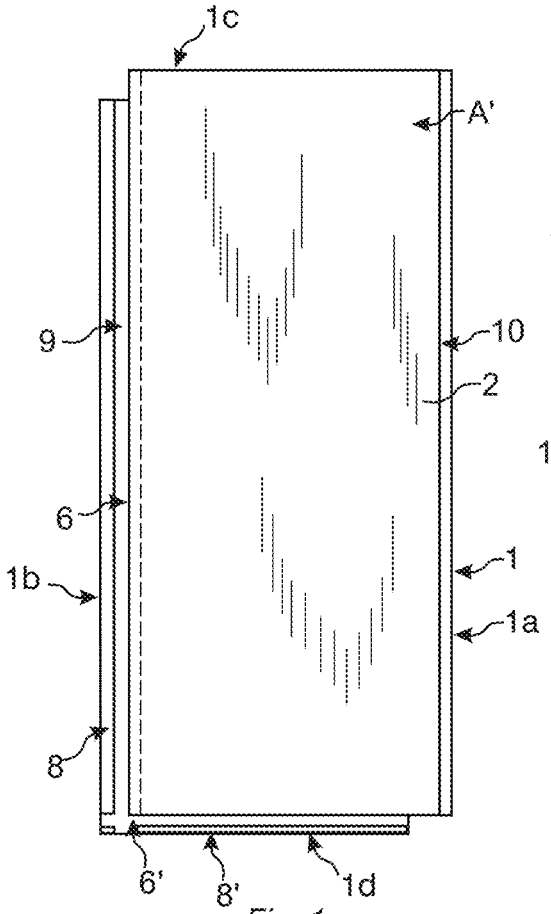
FIGS. 1*a*-1*c* illustrate embodiments of a panel in a top view and in bottom views.
Figure 1B:
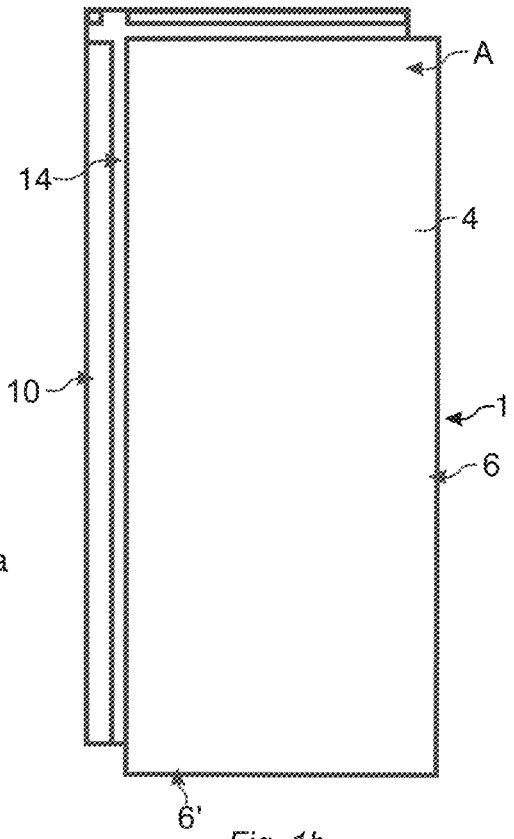
Figure 1C:
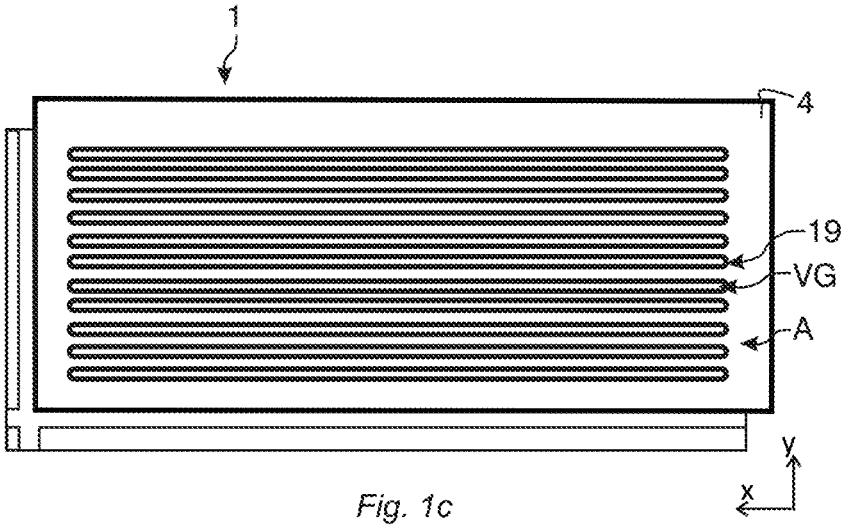

FIGS. 1*a* and 1*c* show in a top view and a bottom view an embodiment of a mineral-based panel 1, such as a floor panel. More specifically, FIG. 1*a* shows a front side 2 of the panel and FIG. 1*c* shows a rear side 4 of the panel comprising at least one groove 19 in a rear side of the panel, preferably a plurality of grooves. For reference, FIG. 1*b* illustrates in a bottom view a rear side 4 of the panel before grooves 19 is formed therein.

Below, embodiments of the mineral-based panel 1 will mostly be described in the context of a floor panel, but it is understood that the panel also may be a building panel, a wall panel, a ceiling panel or a furniture panel.

Figure 2A:
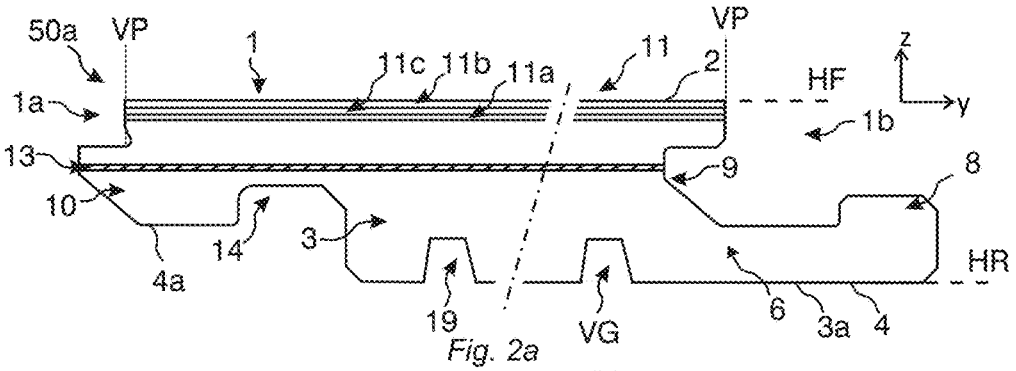
FIGS. 2*a*-2*e* illustrate embodiments of a panel in a cross-sectional side view and in bottom views.

As shown in an embodiment in the cross-sectional side view in FIG. 2*a*, the panel 1, such as that in FIGS. 1*a*-1*c*, comprises a mineral-based core 3. In one example, the core comprises magnesium oxide and, optionally, magnesium chloride and/or magnesium sulphate. In one example, the core comprises cement. The core may further comprise least one selected from the group of a filler, additive(s) and a binding agent. In this embodiment, the at least one groove 19 is provided in a lower side 3*a* the core 3.

A top structure 11 is provided on, such as attached to, an upper side 3*b* of the core 3. Various types of top structures are conceivable. The top structure 11 may comprise a décor layer 11*a*. In a first example, the décor layer 11*a* comprises a printed décor, such as a digitally printed décor. In a second example, the décor layer comprises a print film. The printed décor may be provided directly on the upper side of the core. Optionally, a primer may be provided on the core under the printed décor. Moreover, a coating layer 11*b*, such as a UV curable coating layer, a lacquer or a hot-melt coating layer, and/or a wear layer 11*c* may be provided on the décor layer. In some examples, the coating layer 11*b* may be provided on the wear layer 11*c*.

In the embodiments in the cross-sectional side views in FIGS. 3*a*-3*g* and 4*a*-4*g*, the panel may comprise a mineral-based core 3 in accordance with any of the embodiments and examples described in relation to FIGS. 1*a*-1*c* and 2*a*-2*e*, whereby reference is made thereto.

Figure 3A:
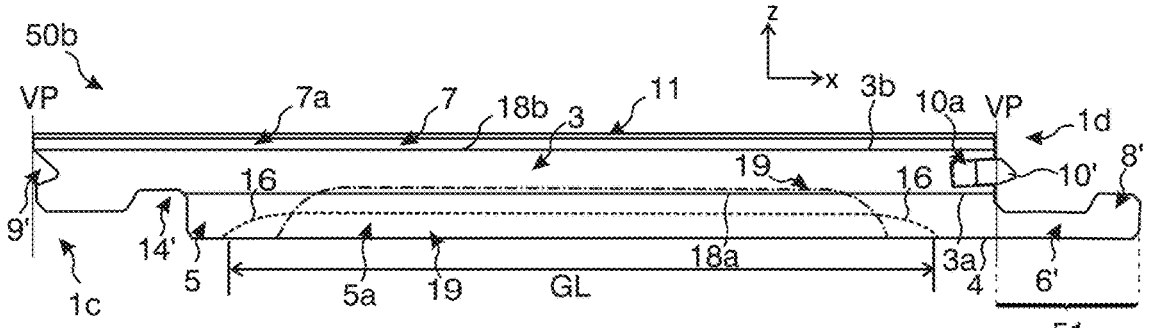
FIGS. 3*a*-3*g* illustrate embodiments of a panel in cross-sectional side views and zoomed-in cross-sectional side views of a panel.
Figure 3B:
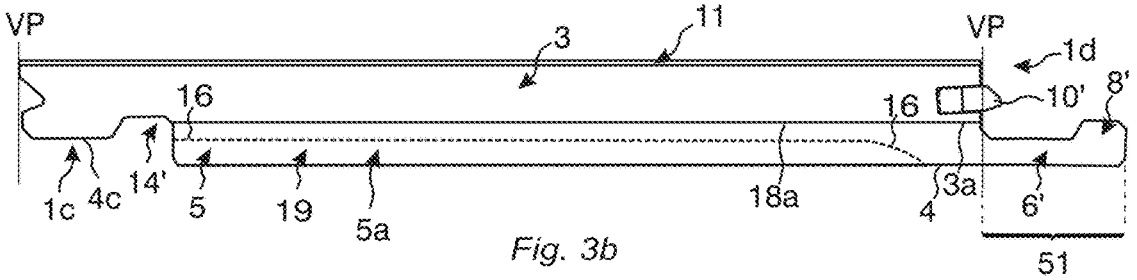

As shown in FIGS. 3*a*-3*b*, the panel may further comprise a lower arrangement 5 which is attached to the lower side 3*a* of the core 3. The lower arrangement 5 may comprise at least one lower layer, such as one lower layer 5*a* as shown in FIGS. 3*a* and 3*b*. FIGS. 3*d* and 3*f* illustrate a zoomed-in view of the lower arrangement 5 in any of the embodiments in FIGS. 3*a*-3*b* comprising two lower layers 5*a*, 5*b* and three lower layers 5*a*, 5*b*, 5*c*, respectively.

The at least one groove 19 may be at least partly provided in the lower arrangement 5 as shown in FIGS. 3*a*-3*b*, 3*d* and 3*f*. As shown in FIG. 3*f* and in FIG. 3*a*, indicating the groove(s) 19 by a dash-dotted line, the at least one groove may fully penetrate at least one lower layer 5*a*. As shown in FIG. 3*a* by the dash-dotted line, the at least one groove 19 may fully penetrate the lower arrangement 5, preferably extending into the core 3.

Figure 3C:
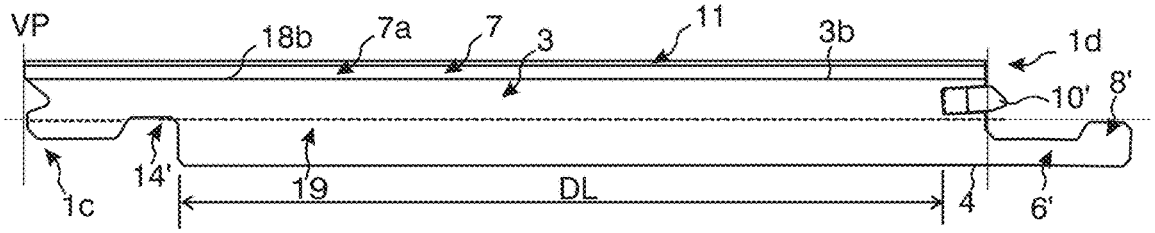
Figure 3D:
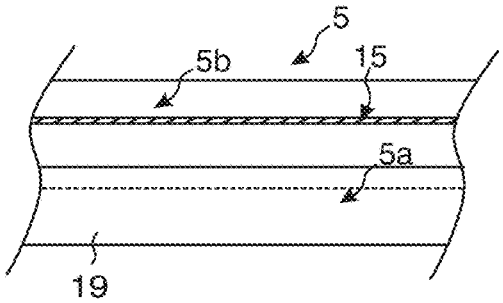
Figure 3E:
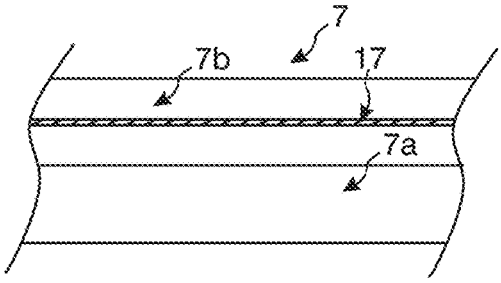
Figure 3F:
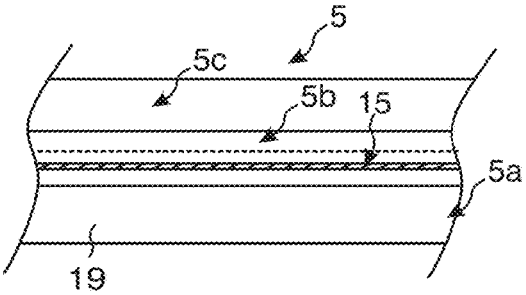
Figure 3G:
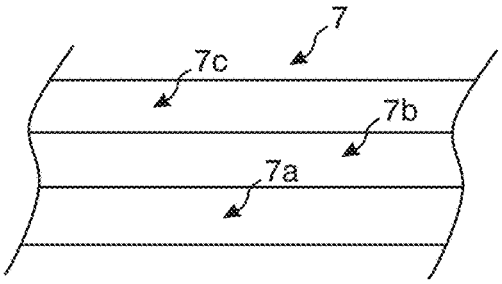

As shown in FIGS. 3*a* and 3*c*, the panel may further comprise an upper arrangement 7 which is attached to the upper side 3*b* of the core 3. The upper arrangement 7 may comprise at least one upper layer, such as one upper layer 7*a* as shown in FIGS. 3*a* and 3*c*. FIGS. 3*e* and 3*g* illustrate a zoomed-in view of the upper arrangement 7 in any of the embodiments in FIGS. 3*a* and 3*c* comprising two upper layers 7*a*, 7*b* and three upper layers 7*a*, 7*b*, 7*c*, respectively.

In any of the embodiments herein, such as in any of FIGS. 3*a*-3*g*, a density of the at least one lower layer, such as all lower layers, may be larger than a density of the core. Moreover, in any of the embodiments herein, a density of at least one upper layer, such as all upper layers, may be larger than a density of the mineral-based core.

The panel in any of the FIGS. 3*a*-3*c* may comprise a top structure 11 provided on, such as attached to, the upper side 3*b* of the core in FIG. 3*b* or provided on, such as attached to, the upper arrangement 7 in FIGS. 3*a* and 3*c*. Embodiments and examples of the top structure 11 in FIGS. 3*a*-3*c* may be similar to any of the embodiments and examples described in relation to FIGS. 1*a*-1*c* and 2*a*-2*e*, whereby reference is made thereto.

In some embodiments, the lower 5 and/or upper 7 arrangement(s), such as in any of FIGS. 3*a*-3*g*, may comprise at least one polymer-based layer.

Any, or preferably both, of the lower 5 and upper 7 arrangements may comprise at least one thermoplastic layer 5*a*-*c*, 7*a*-*c*, for example comprising PVC, PE, TPU, PP, PET or ABS. The core 3 may comprise magnesium oxide and, optionally, magnesium chloride and/or magnesium sulphate.

Any, or preferably both, of the lower 5 and upper 7 arrangements may comprise at least one thermosetting layer 5*a*-*c*, 7*a*-*c*, for example comprising a melamine-formaldehyde resin, epoxy resin, preferably crosslinked with an amine hardener, PU, polyurea or acrylate polymers.

In some embodiments, the lower 5 and/or upper 7 arrangement(s), such as in FIGS. 3*a*-3*g*, may comprise at least one wood-based layer or cellulose-based layer, such as a veneer, paper, solid wood layer, MDF layer, HDF layer, DPL layer, HPL layer, or particle board layer.

At least one lower layer, preferably all lower layers, may comprise magnesium oxide and, optionally, magnesium chloride and/or magnesium sulphate. Moreover, at least one upper layer, preferably all upper layers, may comprise magnesium oxide and, optionally, magnesium chloride and/or magnesium sulphate. Any of these embodiments may be particularly advantageous when the core comprises magnesium oxide.

At least one lower layer, preferably all lower layers, may comprise cement, such as at least 30 wt % of cement. Moreover, at least one upper layer, preferably all upper layers, may comprise cement, such as at least 30 wt % of cement. Any of these embodiments may be particularly advantageous when the core comprises cement.

Figure 4A:
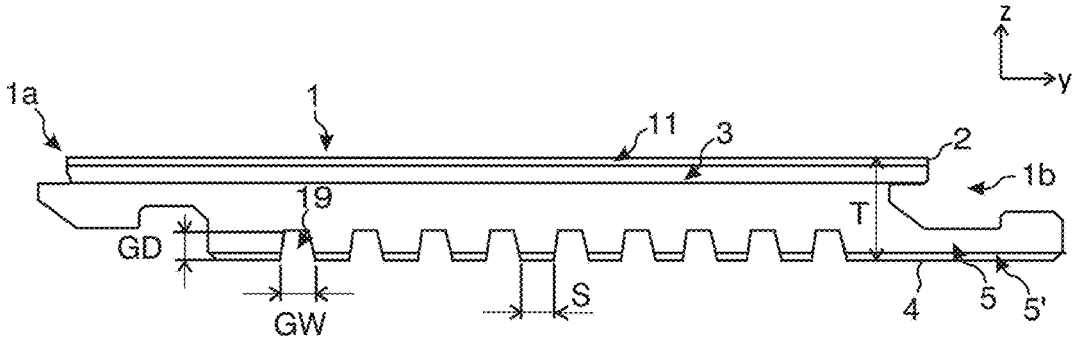
FIGS. 4*a*-4*g* illustrate embodiments of a panel in cross-sectional side views and zoomed-in cross-sectional side views of a panel.

Embodiments and examples of the panel 1 in the cross-sectional side views in FIGS. 4*a*-4*g*, such as the lower 5 and upper 7 arrangements and the top structure 11, may be largely analogous to the embodiments and examples described in relation to FIGS. 1*a*-1*c*, 2*a*-2*e* and 3*a*-3*g*, whereby reference is made thereto. In addition, FIG. 4*a* illustrates that the lower arrangement 5 may comprise a backing layer 5', which the groove(s) 19 preferably fully penetrate.

Generally herein, the panel may extend in a first horizontal direction x and in a perpendicular second horizontal direction y. Moreover, the panel may extend in a vertical direction z which may be perpendicular to the first and second horizontal directions. The panel 1 may comprise a first pair of opposite edge portions 1*a*, 1*b*, which may be long edge portions, and a second pair of opposite edge portions 1*c*, 1*d*, which may be short edge portions. The long edge portions may extend along the first horizontal direction x and the short edge portions may extend along the second horizontal direction y.

Preferably, and as shown in e.g. FIGS. 1*c*, 2*a*-2*e*, 3*a*-3*c*, 3*d*, 3*f* and 4*a*-4*d*, the at least one groove 19 extends along the first horizontal direction x, which may be parallel with the long edge portions. However, as illustrated in a bottom view in the embodiment in FIG. 6*d*, it is equally conceivable that the at least one groove extends along the second horizontal direction y, which may be parallel with the short edge portions. In some embodiments, the panels may be essentially square and the at least one groove 19 may extend along one pair of opposite edge portions.

The panel in any of the embodiments in FIGS. 1*a*-1*c*, 2*a*-2*e*, 3*a*-3*g* and 4*a*-4*g* may comprise a locking system 50*a* on the first pair 1*a*, 1*b* of opposite edge portions. The locking system may comprise a tongue 10 and a tongue groove 9 on the respective edge portion for vertical locking. For example, the tongue and tongue groove may be integrally formed with the panel. The locking system may further comprise a locking groove 14 and a locking element 8 on the respective edge portion for horizontal locking. The locking element is preferably provided on a strip 6 extending horizontally beyond an upper portion of the panel 1.

Alternatively, or additionally, any of the panels in FIGS. 1*a*-1*c*, 2*a*-2*e*, 3*a*-3*g* and 4*a*-4*g* may comprise a locking system 50*b* on the second pair 1*c*, 1*d* of opposite edge portions. The locking system may comprise a tongue 10' and a tongue groove 9' on the respective edge portion for vertical locking. For example, and as shown in FIGS. 3*a*-3*c*, the tongue 10' may be a separate locking tongue 10" provided in a displacement groove 10*a*, preferably providing a fold down locking system. A non-limiting embodiment of a separate locking tongue 10" is illustrated in FIG. 7*e* in a cross-sectional top view. This so-called bristle tongue is preferably formed in one-piece and comprises flexible protrusions 28. The locking system may further comprise a locking groove 14' and a locking element 8' on the respective edge portion for horizontal locking. The locking element is preferably provided on a strip 6' extending horizontally beyond an upper portion of the panel 1.

Figure 2B:
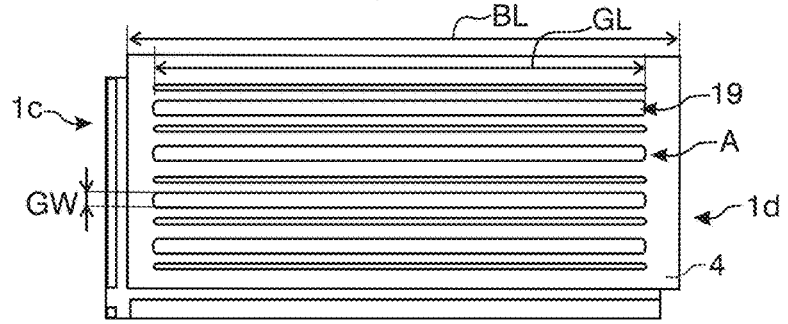

FIGS. 2*b*-2*e* show various geometries and patterns of the grooves 19 in top views. At least some grooves 19 may have different groove widths GW as shown in FIG. 2*b*.

Preferably, the grooves 19 are formed in an interior of the rear side 4 and are spaced from the first 1*a*, 1*b* and/or second 1*c*, 1*d* pair of opposite edge portions, preferably both of them. For example, the entire parts of the at least one groove may be provided inside a vertical plane VP at all edge portions 1*a*-d. The vertical plane VP may be defined by immediately juxtaposed upper portions of two neighboring joint edge portions of two joined panels, such as floor panels, and may be perpendicular to a horizontal plane HF and/or HR, respectively, provided along the front side 2 and rear side 4. A groove length GL of at least some grooves 19, preferably all grooves, may be smaller than a length BL, preferably a maximal length, of the rear side. The length BL may be a length which is parallel with the long edge portions of the panel.

The at least one groove 19 in any of FIGS. 1*a*, 1*c*, 2*a*-2*e*, 3*a*-3*g* and 4*a*-4*g* etc. may be provided inwardly of the locking system on the first 1*a*, 1*b* and/or second 1*c*, 1*d* pair of opposite edges. The groove length GL of the at least one groove, preferably all grooves, may be smaller than a distance DL between the locking systems at opposite short edge portions 1*c*, 1*d*.

Figure 2C:
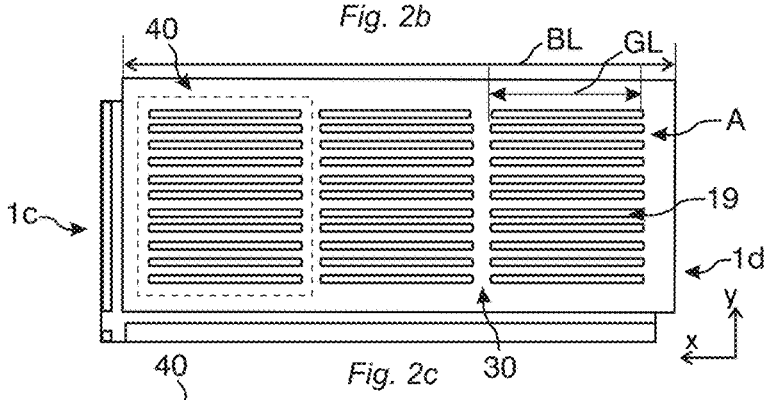
Figure 2D:
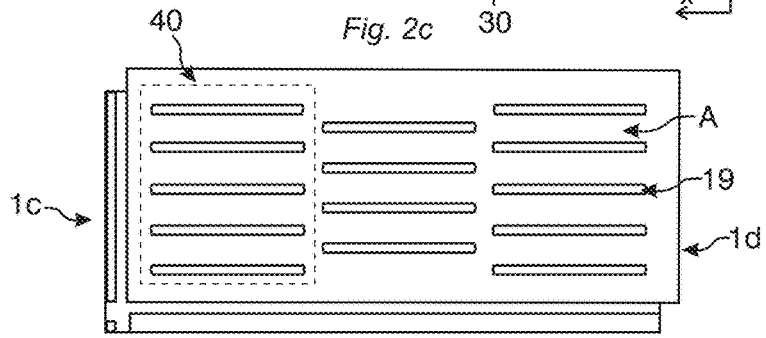
Figure 2E:
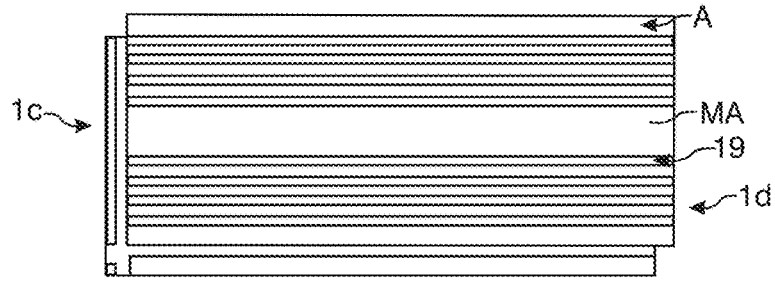

In some embodiments, however, and as shown in the side view in FIGS. 3*b*-3*c* and in FIG. 2*e*, the at least one groove 19 may extend to at least one edge portion 1*c* of a pair of opposite edge portions, such as opposite short edge portions 1*c*, 1*d*, of the panel. In FIG. 3*b*, the at least one groove 19 extends to one edge portion 1*c*, which is illustrated as a short edge portion. In FIG. 3*c*, the at least one groove 19 extends to both edge portions 1*c*, 1*d* of the pair, which are illustrated as short edge portions 1*c*, 1*d*. When the groove(s) 19 extend to a locking groove 14 or 14', they may be provided below an underside 4*a* or 4*c*, respectively, of the corresponding edge portion. The underside 4*a*, 4*c* may be a lowermost portion of the edge portion.

FIGS. 3*a*-3*b* also illustrate that a shape of one or both end portions 16 of the at least one groove 19 along their longitudinal direction may be curved, such as at one or both short edges 1*c*, 1*d*. For example, this shape may be obtained when the grooves are formed by a rotating cutting device, such as a jumping tool. In FIG. 3*a* both end portions 16 are curved. In FIG. 3*b* one end portion 16 is curved and one end portion is parallel with the front side 2, preferably such that it intersects a portion of the locking groove 14'.

FIG. 3*c* shows that the at least one groove 19, in particular its end portion(s) 16, may be parallel with the front side 2, preferably such that they intersect at least a portion of the strip 6' and/or at least a portion of the locking groove 14'.

Figure 6A:
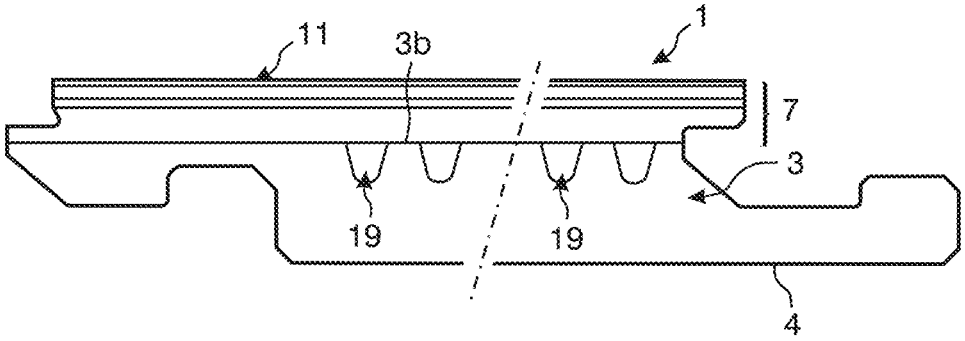
FIGS. 6*a*-6*d* illustrate embodiments of a panel in cross-sectional side views and in a bottom view.
Figure 6B:
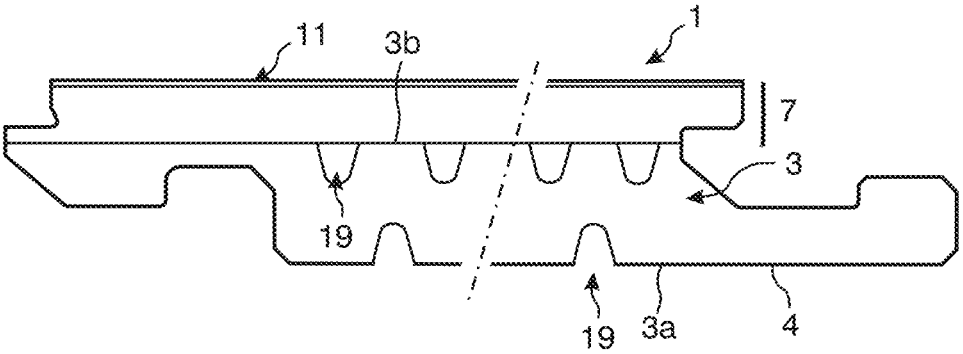
Figure 6C:
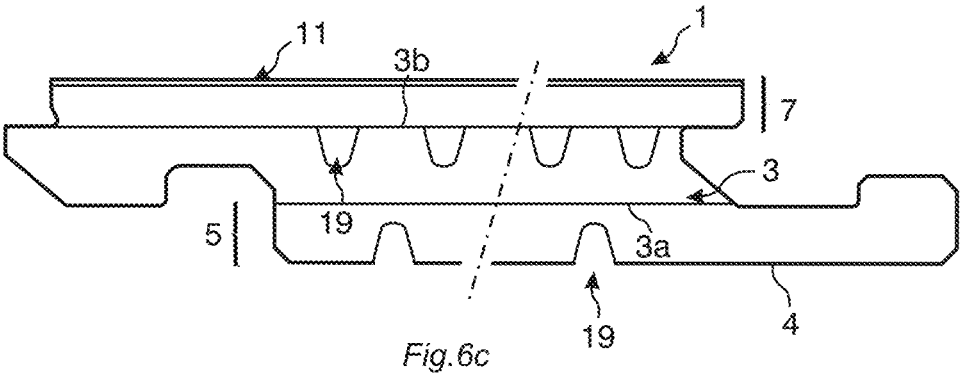
Figure 6D:
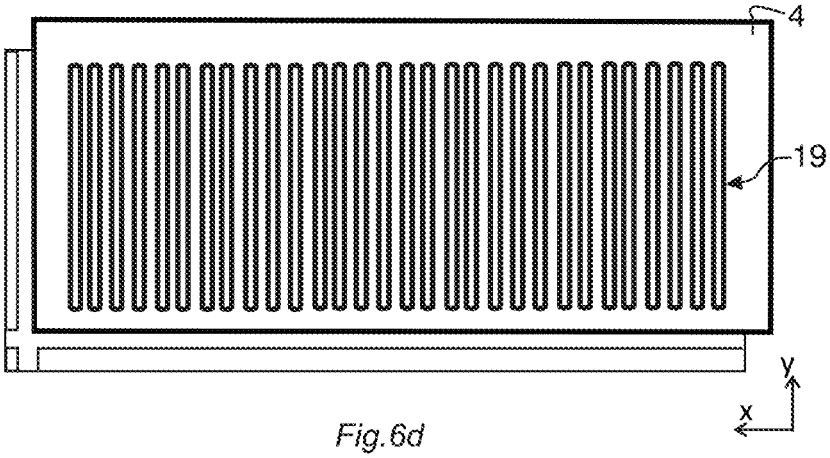

The at least one groove may be continuous as shown in e.g. FIGS. 1*c*, 2*b*, 2*e*, and 3*a*-*c*, preferably along the first horizontal direction x, or along the second horizontal direction y as shown in FIG. 6*d*.

The at least one groove may be discontinuous as shown in e.g. FIGS. 2*c*-2*d*. Preferably, the at least one groove is discontinuous along the first horizontal direction x. The panel 1 may comprise at least two groove arrangements 40, such as a plurality of them. A longitudinal extension of the grooves 19 in each groove arrangement may be parallel to each other. Preferably, a longitudinal extension of each groove arrangement, such as along the first horizontal direction x, may be parallel to each other and preferably extends in parallel with an edge portion 1*a*, 1*b* of the panel, preferably a long edge portion, which may be an edge portion of the first pair.

As illustrated in FIG. 2*c*, the grooves in a pair of adjacent groove arrangements 40, preferably all of them, may be aligned along the second horizontal direction y. As illustrated in FIG. 2*d*, the grooves in a pair of adjacent groove arrangements 40, preferably all of them, may be offset along the second horizontal direction y.

The groove arrangements 40 may be discontinuous, such as along the first horizontal direction x. The groove arrangements 40 may be separated by a separation portion 30. Preferably, the separation portion extends continuously between a pair of opposite edge portions 1*a*, 1*b*, such as long edge portions, along the second horizontal direction y. For example, the separation portion may be rectangular.

In some embodiments, there may be a middle area MA without any grooves as shown in FIG. 2*e*. The grooves 19 may be located mainly at the outer parts of the panel 1, such as rear side 4, preferably along the second horizontal direction y. This may be used to increase the stability of the panel.

Before grooves are formed in the panel 1, an area A' of the front side 2 may be essentially the same as an area A of the rear side 4, cf. FIGS. 1*a*-1*b*. The area of the front side and rear side may be an area in a horizontal plane HF and HR, respectively, provided along the front side and rear side.

The at least one groove reduces the area A of the rear side. The area A of the rear side may be less than 90% of the area A' of the front side, such as 60-85%. In some embodiments the area A may be less than 80% of the area A', such as less than 70%. Alternatively, or additionally, a volume VG of the groove(s) may be at least 5 vol %, such as at least 10 vol %, preferably 5-30 vol %, such as 10-20 vol %.

A plurality of grooves 19 may have the same characteristics, such as groove depths GD and/or groove widths GW. Alternatively, or additionally, a cross-sectional shape of at least two grooves may be the same. As shown e.g. in the embodiments in FIGS. 2*a* and 4*a*-4*c*, the groove depths GD and the groove widths GW of a plurality of grooves may be the same. The groove depth may be a length along the vertical direction z.

At least two grooves of a plurality of grooves 19 may have different characteristics, such as groove depths GD and/or groove widths GW. Alternatively, or additionally, a cross-sectional shape CS of at least two grooves may be different. FIG. 4*d* shows in an embodiment a cross-sectional side view of a panel 1 wherein a groove depth GD of at least two grooves 19 may be different. For example, inner grooves 19*b* along the second horizontal direction y may be formed with a different groove depth GD than outer grooves 19*a*. For example, grooves of each groove arrangement 40 may have the same characteristics while the characteristics of at least two different groove arrangements 40 may differ.

FIG. 4*d* also shows that a groove width GW of at least two grooves 19 may be different. Moreover, at least one groove 19*c* may comprise an opening having a groove width GW that is larger than a groove width of an inner part of the at least one groove.

FIG. 4*d* also shows that a cross-sectional shape CS of at least two grooves 19 may be different.

In non-limiting examples, any groove depth GD herein may be at least 0.2, such as at least 0.3, preferably at least 0.4, times a thickness T of the panel 1. The groove depth GD may be for example 0.1-0.6 times the panel thickness T. When the thickness is 2-40 mm, a groove depth of any of the grooves may be at least 0.2-24 mm, such as 0.5-10 mm. For example, a floor panel having a thickness of 2-10 mm may have groove depth which is at least 0.2-1.0 mm, such as 1.2-6.0 mm.

In any of the embodiments described above, the groove width GW may be 0.2-1.5, such as 0.5-1.0, times the panel thickness T. Moreover, there may be a space S extending between the grooves along the second horizontal direction y. For example, the space S may be at least 0.2-1.0 times the panel thickness T.

In in any of the embodiments herein, such as in FIGS. 1*a*-1*c*, 2*a*-2*e*, 3*a*-3*g* and 4*a*-4*g* the mineral-based panel may comprise at least one reinforcement layer, such as a glass-fibre layer.

As shown in FIG. 2*a*, the at least one reinforcement layer 13 may be provided in the core 3. In a first example, a single reinforcement layer 13 may be provided in a centre portion of the core. In a second example, and as shown in FIG. 4*e*, the at least one reinforcement layer 13 may be positioned in a top portion and/or a bottom portion of the core 3. For example, at least one, preferably a single, reinforcement layer may be positioned essentially at the upper 3*b* and/or lower 3*a* side of the core.

Figure 4B:
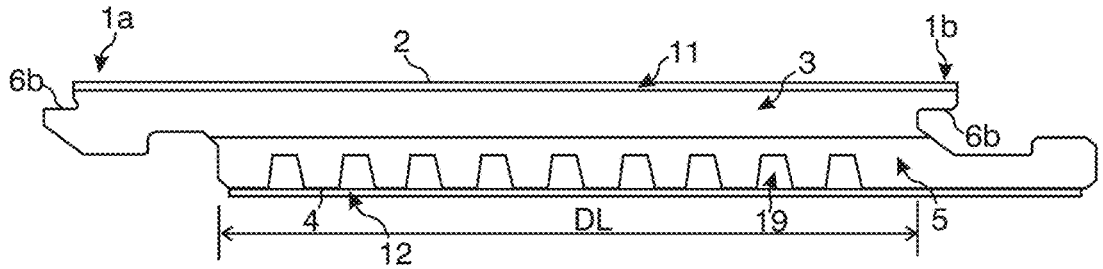
Figure 4C:
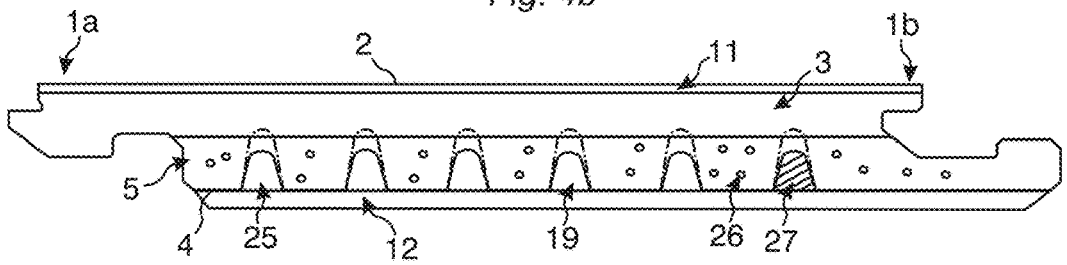
Figure 4D:
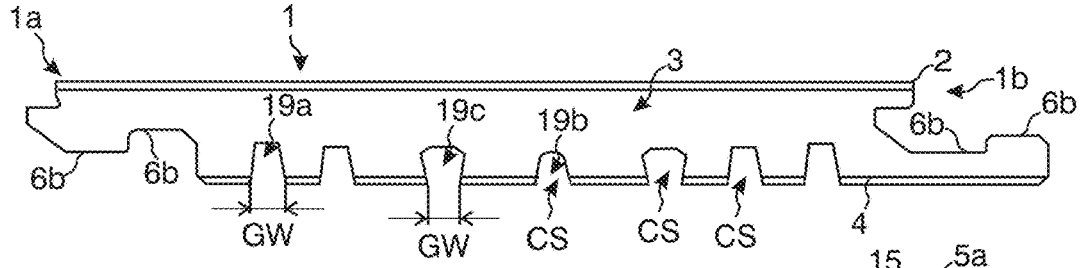
Figure 4E:
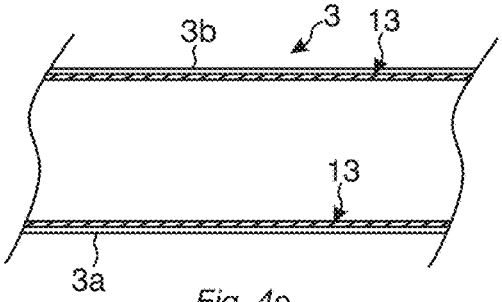
Figure 4F:
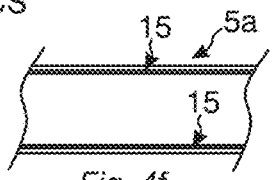
Figure 4G:
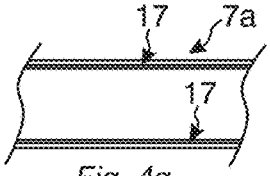

Generally, and as shown in FIGS. 4*f*-4*g*, at least one reinforcement layer 15, 17 may be positioned in a top portion and/or a bottom portion of any lower layer 5*a* and/or upper layer 7*a*.

Alternatively, or additionally, and as shown in e.g. FIGS. 3*a*-3*c*, the at least one reinforcement layer 18*a*, 18*b* may optionally be provided between the core 3 and the upper arrangement 7 and/or between the core 3 and the lower arrangement 5.

The at least one reinforcement layer 17, 15 may be provided in any upper layer 7*a*, 7*b*, 7*c* and/or any lower layer 5*a*, 5*b*, 5*c*, as illustrated in FIGS. 3*d*-3*f*.

The at least one groove may be provided below the at least one reinforcement layer, such as below any, some or all of the at least one reinforcement layer selected from the group of the reinforcement layers 13, 15, 17 and 18*a*-b described above. In some embodiments, however, and as shown in e.g. FIG. 3*f*, the at least one groove may be provided through at least one reinforcement layer 15. This is also illustrated in FIG. 3*a* where the groove(s) 19 indicated by a dash-dotted line may be provided through a reinforcement layer 18*a*.

Alternatively, or additionally, to the reinforcement layers, the core 3, and optionally any lower 5*a*, 5*b*, 5*c* and/or upper 7*a*, 7*b*, 7*c* layer, may comprise separate reinforcement particles 26, such as fibres. In some embodiments, and as illustrated in FIG. 4*c*, a lower layer 5*a*, 5*b*, 5*c*, such as a bottommost layer 5*a*, of the lower arrangement 5 or the core 3 may comprise separate reinforcement particles 26. The at least one groove 19 may be provided in the lower layer 5*a* only, in the core 3 only, or, as illustrated by the dash-dotted line in FIG. 4*c*, may extend into the core 3. Optionally, the core 3 or the upper arrangement may in the either scenario comprise intact reinforcement layer(s).

FIGS. 4*b*-4*c* illustrate that the at least one groove 19 may be covered with a cover layer 12, which preferably is separately formed. Generally, the cover layer may be attached to the lower side 3*a* of the core or the lower arrangement 5. For example, the cover layer may be a flexible layer, such as a foam layer. The cover layer may be a foam rubber, cork, a natural material. This may be used to hide the grooves, such as an opening 25 of the grooves, for example for providing a moisture sealing or to improve the sound properties of the panel.

In some embodiments, the at least one groove may be at least partially filled, such as completely filled, with a separate material 27. Preferably, the separate material may impact the properties of the panel, such as its sound properties. This may be particularly advantageous when a cover layer 12 is provided on the rear side 4, such as in FIG. 4*c*.

Figure 5A:
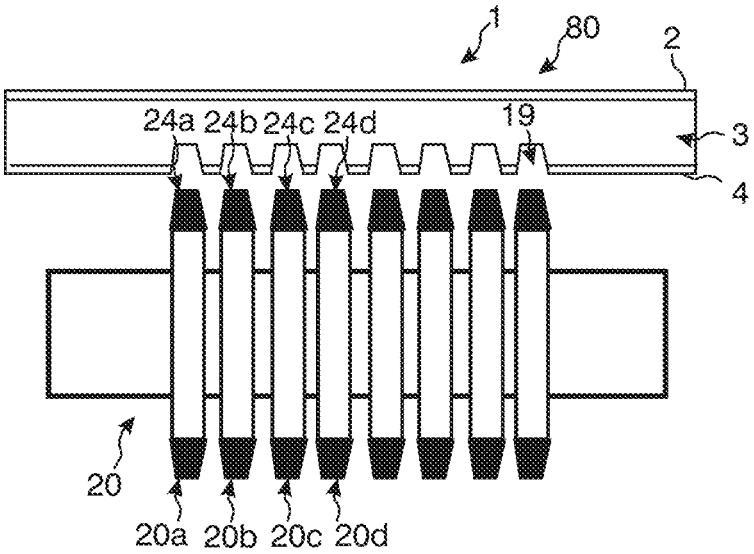
FIGS. 5*a*-5*e* illustrate in side views and in perspective views embodiments of methods for providing grooves in a panel and in a side view an embodiment of a panel or a board element before providing groove(s) and/or a locking system therein.
Figure 5B:
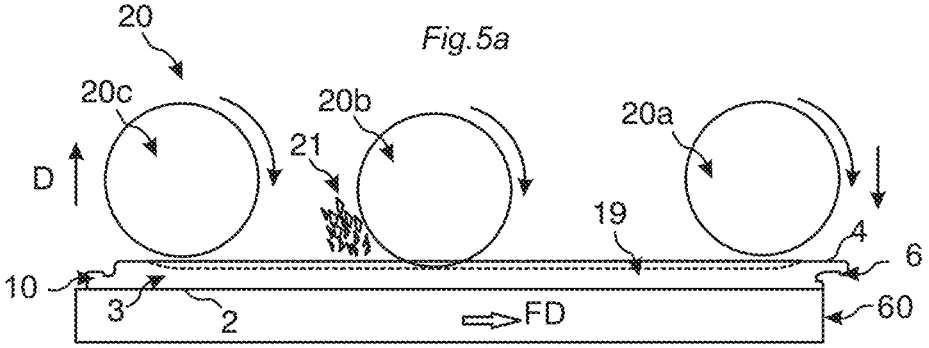

FIGS. 5*a*-5*b* show embodiments of a method of forming the at least one groove 19 in a rear side 4 of a panel 1, such as in a mineral-based core 3 and/or in a lower arrangement 5 of the panel. For example, the lower arrangement may comprise any of the polymer-based layer(s) described herein. Alternatively, and as described herein, the lower arrangement may comprise wood-based layer(s) or cellulose-based layer(s) or it may comprise magnesium oxide. The panel is arranged on a support member 60. The grooves may be formed by a rotating operation. A rotating cutting device 20, for example comprising at least one saw blade 20*a*-20*d*, may be used. The rotating cutting device may comprise at least one tooth element 24*a*-24*d*. The saw blades 20*a*-20*d* may be arranged side-by-side as shown in FIG. 5*a*. Preferably, the rotating cutting device displaceably mounted in a frame member (not shown) and may be a jumping tool. The panel may be displaced in a feeding direction and may pass by the rotating cutting device. The front side 2 may point downwards during forming of the grooves. The rotating cutting device, such as the at least one saw blade, and the panel may be displaced relative to each other for forming the grooves. For example, the rotating cutting device may be displaced along a displacement axis D towards the panel and away from the panel, such as from above, or, alternatively, from below if the front side 2 is pointing upwards. Thereby, a plurality of grooves 19 may be formed in accordance with any embodiment described herein, such as in any of FIGS. 1*a*-1*c*, 2*a*-2*e*, 3*a*-3*g*, 4*a*-4*g*, 6*a*-6*d* or 7*a*-7*b*. Preferably, the grooves are formed in an interior of the rear side 4 and being spaced from the first and/or second pair of opposite edge portions 1*a*, 1*b* and 1*c*, 1*d*, preferably both of them. For example, the grooves may be formed such that they do not intersect any part of the locking systems on the long and/or short edge portions.

Figure 5C:
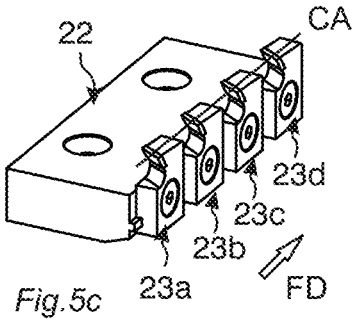
Figure 5D:
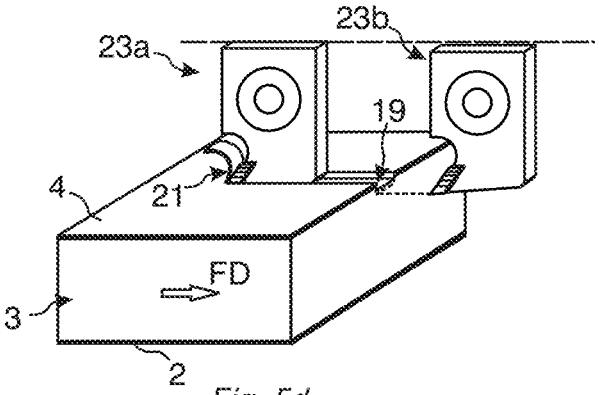

In some embodiments, the grooves 19 may be formed by a non-rotating operation, such as by carving. A non-rotating tool may be utilized, for example a carving tool 22 comprising at least one tooth element 23*a*-23*d*. FIG. 5*c* shows a carving tool 22 comprising a plurality of tooth elements 23*a*-23*d*. The tooth elements may be located after each other along a carving axis CA. In operation of the carving tool 22, the carving axis may be parallel with a feeding direction FD. The tooth elements may be offset in a direction which is perpendicular to the feeding direction, such as horizontally and/or vertically offset. The tooth elements may be configured to consecutively remove material from the panel.

Preferably, the carving tool 22 is fixedly mounted in a frame member (not shown), at least in a direction along the carving axis CA. In operation of the carving tool, the panel may be displaced with respect to the frame member in the feeding direction. The panel may be displaced against the carving tool 22 in the feeding direction FD. Each tooth may carve at least 0.05 mm, such as at least 0.1 mm, for example 0.05-0.5 mm, e.g. in a mineral-based material, such as in the core 3 and/or in the lower arrangement 5.

In some embodiments, however, the carving tool may be displaceably mounted in the frame member. For example, carving tool may be a jumping carving tool.

The material 21 removed from the panel when forming the grooves, such as chips, may be recycled. Magnesium oxide may be recycled, such as fully recycled, for example by heating the removed material above a critical temperature so that it assumes powder form.

The method described above is equally conceivable for a mineral-based board element 80. The mineral-based board element may be dividable or may be divided into at least two panels 1, such as by sawing, cutting or breaking. In a first example, the grooves are formed before dividing the board element. In a second example, the grooves are formed after dividing the board element. In the second example, the grooves may be formed before or after forming of the locking system on opposite edge portions 1*a*, 1*b* and/or 1*c*, 1*d*.

FIGS. 6*a*-6*c* illustrate in cross-sectional side views embodiments of various locations of the at least one groove 19 in a panel 1. In FIG. 6*a*, the at least one groove 19 is provided in an upper side 3*b* of the core 3. Moreover, FIG. 6*b* illustrates the at least one groove 19 being provided in a lower side 3*a* and an upper side 3*b* of the core 3. Finally, FIG. 6*c* illustrates that the groove(s) may be provided in the core (3), wherein the core is provided between an upper 7 and a lower 5 arrangement. Thereby, the groove(s) become internal groove(s). For example, the at least one groove 19 may be provided in an upper side 3*b* of the core 3 and, optionally, at least partly provided in a lower arrangement 5. For example, the at least one groove may fully penetrate at least one lower layer 5*a* of the lower arrangement. Optionally, the groove(s) may extend into the lower side 3*a* of the core 3. Alternatively, or additionally, to the embodiment in FIG. 6*c*, the groove(s) 19 may be provided in the lower side 3*a*.

Preferably, an upper arrangement 7 comprising at least one upper layer 7*a*, 7*b*, 7*c* is attached to the upper side 3*b* of the core 3 in any of FIGS. 6*a*-6*c*. Embodiments and examples of the core 3, the lower layer 5, the upper layer 7, an optional top structure 11, an optional at least one reinforcement layer 13, 15, 17, 18*a*, 18*b*, a locking system 50*a*, 50*b* etc. have been described elsewhere, such as in relation to FIGS. 1*a*-1*c*, 2*a*-2*e*, 3*a*-3*g* and 4*a*-4*g*, whereby reference is made thereto.

The bottom view in FIGS. 1*c* and 2*b*-2*e* illustrate embodiments of a rectangular panel 1 comprising at least one groove 19 which is parallel with the long edge portions. FIG. 6*d* illustrates in a bottom view an embodiment of a rectangular panel 1 comprising at least one groove 19 which is parallel with the short edge portions.

Figure 7A:
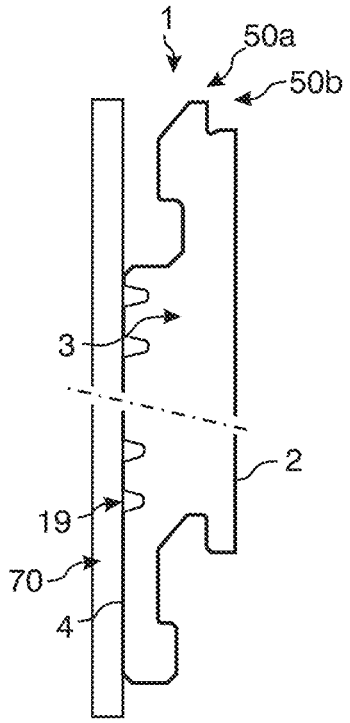
FIGS. 7*a*-7*b* illustrate embodiments of a wall panel and a ceiling panel in cross-sectional side views.
Figure 7B:
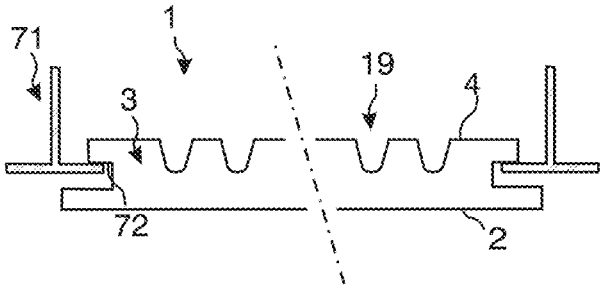
Figure 7D:
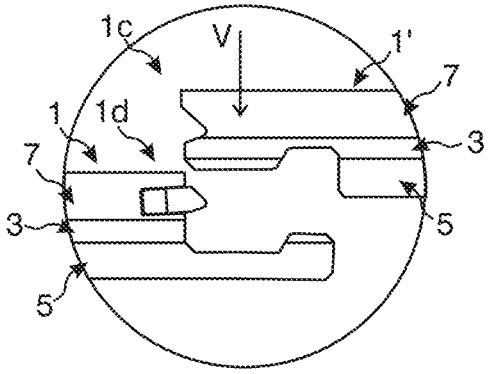
FIGS. 7*c*-7*e* illustrate embodiments of a panel in zoomed-in cross-sectional side views and in a cross-sectional top view.
Figure 7C:
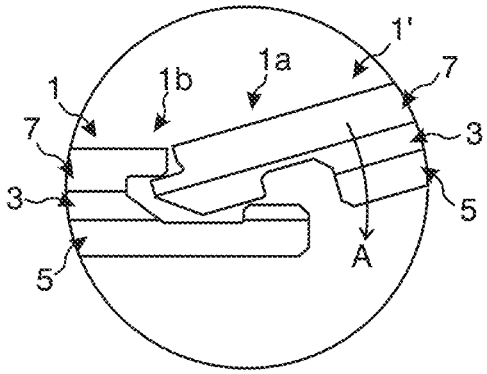
Figure 7E:
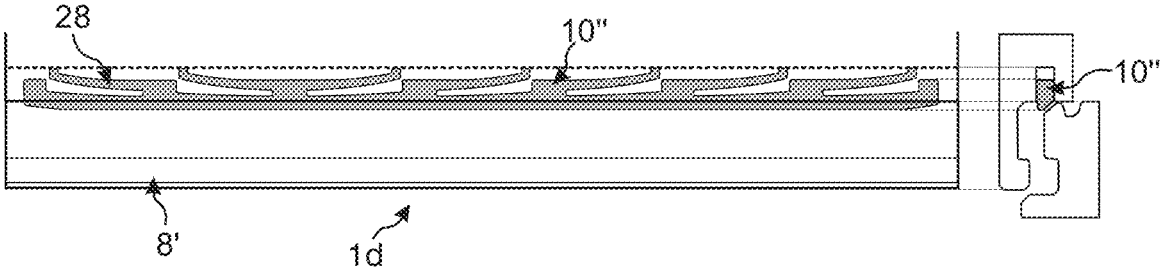

FIGS. 7*a*-7*b* illustrate in cross-sectional side views embodiments of a wall panel 1 and a ceiling panel 1, respectively. Embodiments and examples thereof may be similar to any of the embodiments and examples herein, such as described in relation to FIGS. 1*a*-1*c*, 2*a*-2*e*, 3*a*-3*g*, 4*a*-4*g*, 5*a*-5*d* and 6*a*-6*d*, whereby reference is made thereto.

Optionally, as shown in FIG. 7*a*, the wall panel 1 may comprise a locking system 50*a*, 50*b* for interlocking wall panels of a similar type. The wall panel may be attached to a subwall member 70 in accordance with known principles in the art, such as by clips. In a first example, the wall panel comprises a mineral-based core 3 without any lower 5 and upper 7 arrangements. In a second example, the wall panel comprises a mineral-based core 3 and an upper arrangement 7 and, optionally, a lower arrangement 5.

As shown in FIG. 7*b*, the ceiling panel 1 may comprise engagement portions 72 for installing it in a grid of profiles 71 in accordance with known principles in the art. The groove(s) 19 may face upwards towards a subroof. The ceiling panel may comprise a mineral-based core 3, preferably without any upper 7 and/or lower 5 arrangement(s). For example, the mineral-based core may comprise magnesium oxide or gypsum.

FIGS. 2*a*, 4*a*-4*d*, 6*a*-6*c*, 7*c* and 8*a*-8*b* and FIGS. 3*a*-3*c*, 7*d* and 8*c*-8*e* show embodiments of long edge portions 1*a*, 1*b* and short edge portions 1*c*, 1*d* of a panel configured to be locked by angling A and by a vertical displacement V, respectively.

FIGS. 3*a*-3*b*, 4*a*-4*c*, 6*c*, 7*c*-7*d* and 8*a*-8*e* illustrate embodiments of a mineral-based panel 1, such as a floor panel, comprising a mineral-based core 3 and wherein the lower arrangement 5 may comprise at least one polymer-based lower layer 5*a*, 5*b*, 5*c*. The panel comprises a locking system 50*a*, 50*b* for horizontal and/or vertical locking comprising a strip 6, 6' extending horizontally beyond an upper portion 2*a*, 2*a*' of the panel. At least a horizontal portion 51 of the strip is entirely formed in the lower arrangement 5. Thereby, an upper surface of the strip may be exposed and, provided that there is no cover layer 12 attached to a lower side of the lower arrangement (cf. FIG. 4*c*), a lower surface provided vertically below the upper surface may be exposed.

In any embodiment herein, the lower arrangement 5 may comprise a single lower layer 5*a*, and optionally a second 5*b* and/or a third 5*c* lower layer, cf. FIGS. 3*d* and 3*f*. As shown in e.g. FIGS. 3*a*, 6*c*, 7*c*-7*d*, 8*a*-8*c* and 8*e*, the panel 1 may further comprise an upper arrangement 7 comprising at least one upper layer 7*a*. In any embodiment herein, the upper arrangement 7 may comprise a single upper layer 7*a*, and optionally a second 7*b* and/or a third 7*c* upper layer, cf. FIGS. 3*e* and 3*g*. Embodiments of reinforcement layers 13, 15, 17, 18*a*, 18*b* and/or reinforcement particles 26, which are conceivable for any of the panels in e.g. FIGS. 7*c*-7*e* and 8*a*-8*e*, have been described elsewhere herein, such as in relation to FIGS. 2*a*, 3*a*-3*f*, 4*c* and 4*e*-4*g*, whereby reference is made thereto. Alternatively, additionally, the panel may comprise a top structure 11 as described elsewhere herein.

In any embodiment herein, such as in FIGS. 1*a*-1*c*, 2*a*-2*e*, 3*a*-3*g*, 4*a*-4*g*, 5*a*-5*e*, 6*a*-6*d*, 7*a*-7*e* and 8*a*-8*e*, the core 3 may comprise at least 30 wt % magnesium oxide, and, optionally, magnesium chloride and/or magnesium sulphate. For example, the core 3 may comprise 35-55 wt % magnesium oxide and, optionally, 15-35 wt % magnesium chloride and/or magnesium sulphate. Optionally, the core may further comprise a filler, such as fly ash or calcium carbonate, preferably in an amount of 0-40 wt %, and/or a binding agent, such as wood shavings or wood dust, preferably in an amount of 0-10 wt %. More generally, the core 3 may comprise an inorganic matrix material, preferably with at least 20 wt % of an inorganic matrix material, such as cement, such as hydraulic or non-hydraulic cement, or gypsum.

The polymer-based lower layer(s) 5*a*, 5*b*, 5*c* may be thermoplastic layer(s), for example comprising PVC, PE, TPU, PP, PET or ABS, preferably being provided on the magnesium oxide core 3 described in the previous paragraph. The panel 1 may further comprise thermoplastic upper layer(s) 7*a*, 7*b*, 7*c*, for example comprising PVC, PE, TPU, PP, PET or ABS. In a first example, the panel comprises a lower layer 5*a* and an upper layer 7*a*, each comprising PVC in an amount of 40-60 wt %, a filler, such as calcium carbonate or talc, in an amount of 40-60 wt %, a plasticizer, such as dioctyl terephthalate (DOTP), in an amount of 0-10 wt %, and additive(s), such as pigments, a lubricant, a stabilizer, or an acrylic processing aid, in an amount of 0-5 wt %. In a second example, the panel comprises a lower layer 5*a* and an upper layer 7*a*, each comprising PE, PP, PET, TPU or polyolefin copolymers in an amount of 30-60 wt %, a filler, such as calcium carbonate or talc, in an amount of 40-70 wt %, and additive(s), such as pigments, a coupling agent, a lubricant, or an antioxidant, in an amount of 0-5 wt %. A thickness of the panel may be 5-10 mm, such as 4-7 mm, and a thickness of each of the upper and lower arrangements may be 15-35%, such as 20-40%, of the thickness of the panel.

In some embodiments, the polymer-based lower layer(s) 5*a*, 5*b*, 5*c* may be thermosetting layer(s), for example comprising a melamine resin, epoxy resin, preferably crosslinked with an amine hardener, PU, polyurea or acrylate polymers, preferably being provided on the magnesium oxide core 3 described in the penultimate paragraph above. The panel 1 may further comprise thermoplastic upper layer(s) 7*a*, 7*b*, 7*c*, for example comprising a melamine resin, epoxy resin, preferably crosslinked with an amine hardener, PU, polyurea or acrylate polymers. In a third example, the panel comprises a lower layer 5*a* and an upper layer 7*a*, each comprising an epoxy resin and an amino hardener or polyols and isocyanates in an amount of 40-60 wt %, a filler, such as calcium carbonate, barium sulphate, sand or talc, in an amount of 20-50 wt %, and additive(s), such as pigments, a catalyst, a defoaming agent, a dispersing agent, or a chain extender, in an amount of 0-5 wt %. A thickness of the panel may be 4-7 mm, and a thickness of each of the upper and lower arrangements may be 15-35%, such as 20-40%, of the thickness of the panel.

In any of the first, second and third examples above, the upper and lower arrangements may comprise the same polymer-based material compositions, such as being provided with the core in an ABA layered structure, or different polymer-based material compositions, such as being provided with the core in an ABC layered structure.

FIGS. 4*a*-4*c*, 7*c* and 8*a*-8*b* illustrate a locking system 50*a* around long edge portions 1*a*, 1*b*. The locking system 50*b* in FIGS. 3*a*-3*b*, 7*c*-7*d* and 8*c*-8*e* are shown around their short edge portions 1*c*, 1*d*. Alternatively, or additionally, however, it is equally conceivable to use a locking system 50*a* as in any of FIGS. 8*c*-8*e* on the long edge portions 1*a*, 1*b* of the panels.

In FIGS. 3*a*-3*b*, 4*a*-4*c*, 6*c*, 7*c*-7*d* and 8*a*-8*e* the strip 6, 6' comprises a locking element 8, 8' and the horizontal portion 51 is provided at least horizontally inwardly of the locking element 8, 8'. In FIGS. 3*a*-3*b*, 4*a*-4*c*, 6*c*, 8*b* and 8*d*, the horizontal portion 51 comprises the entire strip including the locking element.

Figure 5E:
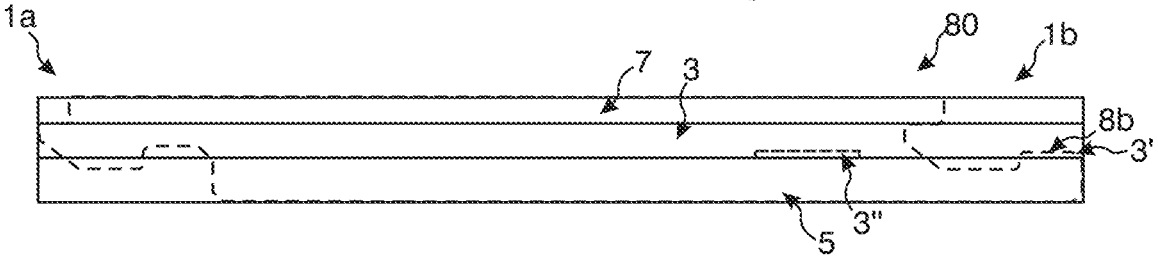

In FIGS. 7*c*-7*d*, 8*a*, 8*c* and 8*e*, the locking element 8, 8' comprises a portion of the core 3, such as at a distal end portion 8*b*, 8*b'* of the locking element. For example, before forming the locking system 50*a*, 50*b* in the panel 1, the core 3, the lower arrangement 5, and optionally the upper arrangement 7, may extend into the edge portion(s) 1*a*-1*d* of the panel, cf. the embodiment of a mineral-based board element 80 in FIG. 5*e*. The locking system may be formed by removing material from the edge portion(s) 1*a*-1*d*. As shown in FIG. 5*e*, a portion 3' of the core 3 may remain in the edge portion after the forming of the locking system, such as at the distal end portion 8*b*, 8*b'* of the locking element. In particular, a portion 3' of the core may remain at substantially the same vertical position as that of an inner portion 3" of the core.

Figure 8A:
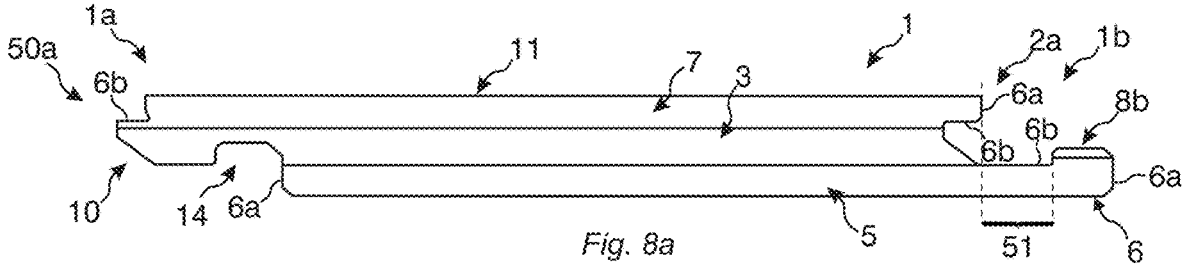
FIGS. 8*a*-8*e* illustrate embodiments of a panel in side views.
Figure 8B:
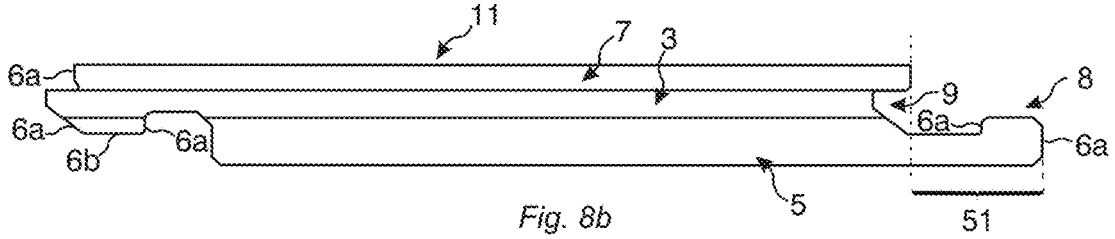

As shown in e.g. FIGS. 3*a*-3*b*, 4*a*-4*c*, 6*c*, 7*c*-7*d* and 8*a*-8*e*, a horizontal locking system may comprise a locking element 8, 8' and a locking groove 14, 14'. A vertical locking system may comprise a tongue 10, 10', 10" and a tongue groove 9, 9'. Alternatively, or additionally, and as shown in e.g. FIGS. 8*c*-8*e*, the locking element 8, 8' and locking groove 14, 14' may comprise vertical locking surfaces 6*b*, 6*b'* configured to cooperate for vertical locking. In FIG. 8*e* there are no vertical locking surfaces situated at the vertical plane.

FIGS. 8*a*-8*e* illustrate that the lower arrangement 5 may comprise a horizontal 6*a*, 6*a'* and/or a vertical 6*b*, 6*b'* locking surface. Horizontal locking surfaces 6*a*, 6*a'* may be provided on the locking element 8, 8' and locking groove 14, 14' and/or vertical locking surfaces 6*b*, 6*b'* may be provided on the tongue 10, 10' and tongue groove 9, 9'. Moreover, a vertical locking surface 6*b* may be provided in an inner 8*a* and/or an outer surface 8*c* of the locking element 8, 8' and may be configured to cooperate with a vertical locking surface 6*b'* provided in an outer 14*c* and/or an inner surface 14*a* of the locking groove, respectively.

Figure 8C:
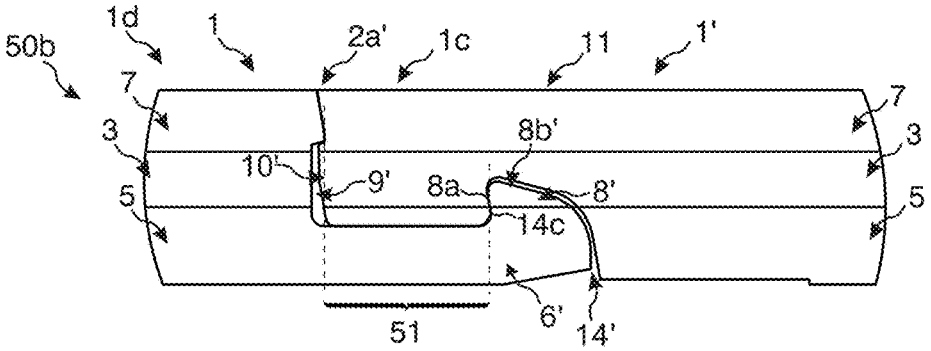
Figure 8D:
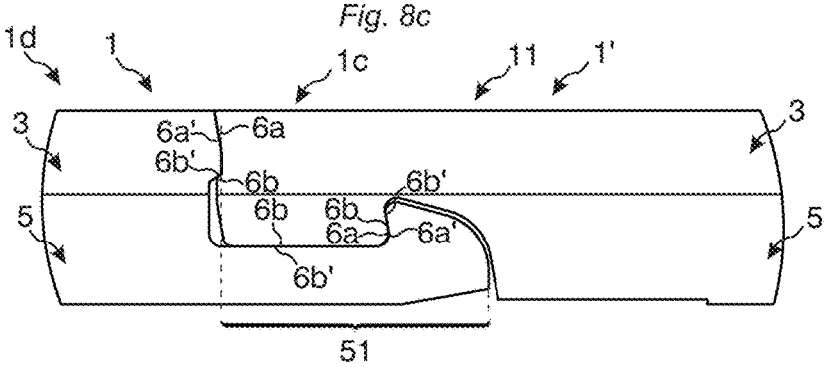
Figure 8E:
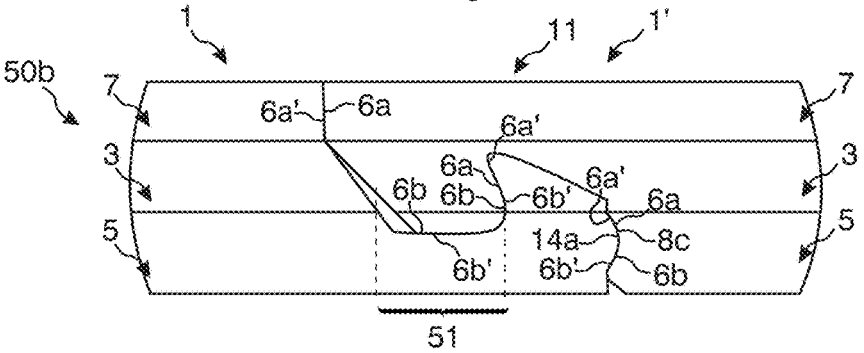

In some embodiments, and as shown in e.g. FIGS. 8*c*-8*e*, the horizontal 6*a*, 6*a'* and vertical 6*b*, 6*b'* locking surfaces may be provided by a common, preferably inclined, surface, for example the inner surface 8*a* and the outer surface 14*c* and/or the outer surface 8*c* and the inner surface 14*a*. The common surface may also be situated at the juxtaposed upper portions of the panels 1, 1' as shown in FIG. 8*d*.

Alternatively, or additionally, and as shown e.g. in FIGS. 8*a*-8*c*, a vertical locking surface 6*b*, 6*b'* may be provided in the upper arrangement 7. Yet alternatively, or additionally, and as shown e.g. in FIGS. 8*a*-8*c* and 8*e*, a horizontal locking surface 6*a*, 6*a*' may be provided in the upper arrangement 7.

It is clear that in some embodiments herein, at least one vertical locking surface 6*b*, 6*b*' may be at least partially provided in the core 3 as shown in e.g. FIGS. 4*b*, 4*d* and 8*d*. Moreover, the tongue 10, 10' and/or the tongue groove 9, 9' may be formed at least partially, such as entirely, in the core 3 as shown in e.g. FIGS. 2*a*, 3*a*-3*c*, 4*b*-4*d*, 6*a*-6*c*, 7*c*-7*d* and 8*a*-8*d*. For example, an outer and/or lower portion of the tongue 10, 10' may comprise a portion of the core 3. Similarly, the displacement groove 10*a* may be formed at least partially, preferably entirely, in the core 3 as shown in e.g. FIG. 3*a*-3*c*. In some embodiments, the tongue 10, 10' and/or the tongue groove 9, 9' may be formed at least partially, such as entirely, in the upper arrangement 7 as shown in e.g. FIGS. 6*a*-6*c*, 7*c*-7*d* and 8*a*-8*c*. Similarly, the displacement groove 10*a* may be formed at least partially, such as entirely, in the upper arrangement 7 as shown in e.g. FIG. 7*d*.

It is understood that embodiments may include a set of panels comprising a plurality of panels 1 in accordance with any of the embodiments and examples herein, such as in FIGS. 1*a*-1*c*, 2*a*-2*e*, 3*a*-3*g*, 4*a*-4*g*, 5*a*-5*d*, 6*a*-6*d*, 7*a*-7*e* and 8*a*-8*e*. Each panel may comprise a locking system 50*a*, 50*b* suitable for interlocking the panels.

The inventive concept has mainly been described above with reference to a few embodiments. However, as is readily appreciated by a person skilled in the art, other embodiments than the ones disclosed above are equally possible within the scope of the inventive concept, as defined by the appended patent claims and items in an embodiment section below. In addition, it is noted that the locking system 50*a*, 50*b* described in relation to e.g. FIGS. 8*a*-8*e* are equally conceivable for the first aspect.

EMBODIMENTS

Further aspects of the inventive concept are provided below. Embodiments and examples of these aspects are largely analogous to the embodiments and examples as described above, whereby reference is made to the above for a detailed description.

Item 1. A mineral-based panel (1), such as a floor panel, comprising a mineral-based core (3), wherein the panel comprises at least one groove (19), preferably a plurality of grooves.

Item 2. The mineral-based panel according to item 1, wherein the at least one groove (19) is provided in a rear side (4) of the panel.

Item 3. The mineral-based panel according to item 1 or 2, wherein the at least one groove is provided in a lower side (3*a*) of the mineral-based core.

Item 4. The mineral-based panel according to any of the preceding items, wherein the at least one groove is provided in an upper side (3*b*) of the mineral-based core.

Item 5. The mineral-based panel according to any of the preceding items, wherein the mineral-based core comprises magnesium oxide and, optionally, magnesium chloride and/or magnesium sulphate.

Item 6. The mineral-based panel according to any of the preceding items, wherein the mineral-based core comprises cement.

Item 7. The mineral-based panel according to any of the preceding items, further comprising a lower arrangement (5) comprising at least one lower layer (5*a*) being attached to a lower side (3*a*) of the mineral-based core.

Item 8. The mineral-based panel according to item 7, wherein the at least one groove is at least partly provided in the lower arrangement, such as the at least one groove fully penetrating at least one lower layer (5*a*) of the lower arrangement.

Item 9. The mineral-based panel according to item 7 or 8, wherein at least one lower layer (5*a*, 5*b*, 5*c*) in the lower arrangement, preferably all lower layers, comprises magnesium oxide and, optionally, magnesium chloride and/or magnesium sulphate.

Item 10. The mineral-based panel according to any of the preceding items 7-9, wherein at least one lower layer (5*a*, 5*b*, 5*c*) in the lower arrangement, preferably all lower layers, comprises cement.

Item 11. The mineral-based panel according to any of the preceding items 7-10, wherein the lower arrangement (5) comprises at least one polymer-based layer, such as at least one thermoplastic layer, for example comprising PVC, PE, TPU, PP, PET or ABS, or at least one thermosetting layer, for example comprising a melamine-formaldehyde resin, epoxy resin, preferably crosslinked with an amine hardener, PU, polyurea or acrylate polymers.

Item 12. The mineral-based panel according to any of the preceding items 7-11, wherein the lower arrangement (5) comprises at least one wood-based layer or cellulose-based layer, such as a veneer, paper, solid wood layer, MDF layer, HDF layer, DPL layer, HPL layer or particle board layer.

Item 13. The mineral-based panel according to any of the preceding items, further comprising an upper arrangement (7) comprising at least one upper layer (7*a*) being attached to an upper side (3*b*) of the mineral-based core.

Item 14. The mineral-based panel according to item 13, wherein at least one upper layer (7*a*, 7*b*, 7*c*) in the upper arrangement, preferably all upper layers, comprises magnesium oxide and, optionally, magnesium chloride and/or magnesium sulphate.

Item 15. The mineral-based panel according to item 13 or 14, wherein at least one upper layer (7*a*, 7*b*, 7*c*) in the upper arrangement, preferably all upper layers, comprises cement.

Item 16. The mineral-based panel according to any of the preceding items 13-15, wherein the upper arrangement (7) comprises at least one polymer-based layer, such as at least one thermoplastic layer, for example comprising PVC, PE, TPU, PP, PET or ABS, or at least one thermosetting layer, for example comprising a melamine-formaldehyde resin, epoxy resin, preferably crosslinked with an amine hardener, PU, polyurea or acrylate polymers.

Item 17. The mineral-based panel according to any of the preceding items 13-16, wherein the upper arrangement (7) comprises at least one wood-based layer or cellulose-based layer, such as a veneer, paper, solid wood layer, MDF layer, HDF layer, DPL layer, HPL layer or particle board layer.

Item 18. The mineral-based panel according to any of the preceding items, further comprising a top structure (11) provided on, such as attached to, an upper side of the mineral-based core or provided on, such as attached to, an upper arrangement (7) of the mineral-based panel, said top structure preferably comprising a décor layer (11*a*).

Item 19. The mineral-based panel according to item 18, wherein the top structure (11) comprises a coating layer (11*b*) , such as a UV curable coating layer, a lacquer or a hot-melt coating layer, and/or a wear layer (11*c*), such as comprising aluminium oxide, a thermoplastic film, or a thermosetting resin.

Item 20. The mineral-based panel according to any of the preceding items, further comprising a cover layer (12) at least partly covering the grooves.

Item 21. The mineral-based panel according to any of the preceding items, further comprising at least one reinforcement layer (13; 15; 17; 18*a*, 18*b*), such as a glass-fibre layer.

Item 22. The mineral-based panel according to item 21, wherein the at least one reinforcement layer (13) is provided in the mineral-based core.

Item 23. The mineral-based panel according to item 21 or 22, wherein at least one reinforcement layer (13) is positioned in a top portion and/or a bottom portion of the mineral-based core.

Item 24. The mineral-based panel according to any of the preceding items, wherein the at least one reinforcement layer (17; 15) is provided in an upper (7) and/or a lower (5) arrangement.

Item 25. The mineral-based panel according to any of the preceding items, further comprising a locking system (50*a*; 50*b*), such as a mechanical locking system, for horizontal and/or vertical locking.

Item 26. The mineral-based panel according to item 25, wherein the horizontal locking system comprises a locking element (8; 8') and a locking groove (14; 14'), and/or wherein the vertical locking system comprises a tongue (10; 10'; 10") and a tongue groove (9; 9').

Item 27. The mineral-based panel according to any of the preceding items, comprising a plurality of grooves, wherein at least two grooves (19) have different characteristics, such as groove depths (GD) and/or groove widths (GW).

Item 28. The mineral-based panel according to any of the preceding items, wherein said at least one groove is provided in an interior of the panel, such as in the rear side (4) of the panel, being spaced from a pair of opposite edge portions (1*c*, 1*d*), such as opposite short edge portions, of the panel, preferably being spaced from all edge portions (1*a*-1*d*) of the panel.

Item 29. The mineral-based panel according to any of the preceding items, wherein the at least one groove (19) extends to at least one edge portion, such as two edge portions, of a pair of opposite edge portions (1*c*, 1*d*), such as opposite short edge portions, of the panel.

Item 30. The mineral-based panel according to any of the preceding items, wherein the at least one groove (19) is provided below an underside (4*a*, 4*c*) of an edge portion (1*a*, 1*c*) comprising a locking groove (14, 14').

Item 31. The mineral-based panel according to any of the preceding items, wherein a shape of one or both end portions (16) of the at least one groove (19) along its longitudinal direction is curved.

Item 32. The mineral-based panel according to any of the preceding items, wherein one end portion (16) is, or both end portions (16), are parallel with a front side (2) of the panel, preferably such that they intersect at least a portion of the strip (6') and/or at least a portion of the locking groove (14').

Item 33. The mineral-based panel according to any of the preceding items, wherein the panel is rectangular with long edge portions (1*a*, 1*b*) and short edge portions (1*c*, 1*d*) and wherein the at least one groove is parallel with the long edge portions.

Item 34. The mineral-based panel according to any of the preceding items, wherein the at least one groove is continuous or discontinuous, preferably being parallel with long edge portions of the panel.

Item 35. The mineral-based panel according to any of the preceding items, comprising at least two groove arrangements (40), such as a plurality of groove arrangements, wherein adjacent pairs of groove arrangements preferably are separated by a separation portion (30).

Item 36. The mineral-based panel according to any of the preceding items, wherein an area (A) of a surface in which the at least one groove is provided, such as the rear side or the lower and/or upper side of the core, is less than 90%, such as less than 80%, of an area (A') of a front side (2) of the panel.

Item 37. A method for forming at least one groove (19) in a mineral-based panel (1), such as a floor panel, comprising:

arranging the panel on a support member (60), and forming at least one groove (19) in the panel by removing material (21), such as chips, from the panel.

Item 38. The method according to item 37, wherein the at least one groove (19) is provided in a rear side (4) of the panel.

Item 39. The method according to item 37 or 38, wherein the at least one groove (19) is formed by rotational processing with at least one tooth element (24*a*-24*d*), such as by a rotating cutting device (20).

Item 40. The method according to any of the preceding items 37-39, wherein the at least one groove (19) is formed by non-rotational processing with at least one tooth element (23*a*-23*d*), such as by carving, preferably using a carving tool (22).

Item 41. The method according to any of the preceding items 37-40, further comprising forming a locking system (50*a*; 50*b*), such as a mechanical locking system, for horizontal and/or vertical locking of the mineral-based panel.

The invention claimed is:

1. A mineral-based panel comprising a mineral-based core comprising magnesium oxide, wherein the panel comprises at least one groove, wherein the at least one groove is provided in a rear side of the panel, wherein the rear side has a rear side surface area, and the front side has a front side surface area, wherein the entire rear side surface area is less than 90% of the entire front side surface area of the front side of the panel.

2. The mineral-based panel according to claim 1, wherein the mineral-based core further comprises at least one of magnesium chloride and magnesium sulphate.

3. The mineral-based panel according to claim 1, wherein the at least one groove is provided in a lower side of the mineral-based core.

4. The mineral-based panel according to claim 1, further comprising a lower arrangement comprising at least one lower layer being attached to a lower side of the mineral-based core.

5. The mineral-based panel according to claim 4, wherein the at least one groove is at least partly provided in the lower arrangement.

6. The mineral-based panel according to claim 4, wherein the lower arrangement comprises at least one polymer-based layer.

7. The mineral-based panel according to claim 6, wherein the at least one polymer-based layer is at least one thermoplastic layer.

8. The mineral-based panel according to claim 1, further comprising an upper arrangement comprising at least one upper layer being attached to an upper side of the mineral-based core.

9. The mineral-based panel according to claim 8, wherein the upper arrangement comprises at least one polymer-based layer.

10. The mineral-based panel according to claim 9, wherein the at least one polymer-based layer is at least one thermoplastic layer.

11. The mineral-based panel according to claim 1, further comprising at least one reinforcement layer provided in the mineral-based core.

12. The mineral-based panel according to claim 1, comprising a plurality of grooves, wherein at least two grooves have different groove depths and/or groove widths.

13. The mineral-based panel according to claim 1, wherein the at least one groove is provided in an interior of the rear side being spaced from a pair of opposite edge portions of the panel.

14. The mineral-based panel according to claim 1, wherein the at least one groove is continuous.

15. The mineral-based panel according to claim 1, comprising a plurality of discontinuous grooves.

16. The mineral-based panel according to claim 1, wherein the at least one groove is parallel with long edge portions of the panel.

17. The mineral-based panel according to claim 1, comprising at least two groove arrangements, wherein adjacent pairs of groove arrangements are separated by a separation portion.

18. The mineral-based panel according to claim 1, wherein the area of the rear side is less than 80% of an area of the front side.

19. The mineral-based panel according to claim 1, wherein the panel is a building panel, a floor panel, a wall panel, a ceiling panel, or a furniture panel.

* * * * *